US011753605B2

(12) United States Patent
Findeisen et al.

(10) Patent No.: US 11,753,605 B2
(45) Date of Patent: Sep. 12, 2023

(54) MULTI-CORE GRANULES

(71) Applicant: Novozymes A/S, Bagsvaerd (DK)

(72) Inventors: Alexander Findeisen, Bagsvaerd (DK); Albert Cervera-Padrell, Frederiksberg (DK); Lei Shang, Smorum (DK); Lotte E. Nissen, Lyngby (DK); Ole Simonsen, Soeborg (DK); Poul Bach, Birkeroed (DK)

(73) Assignee: Novozymes A/S, Bagsvaerd (DK)

( * ) Notice: Subject to any disclaimer, the term of this patent is extended or adjusted under 35 U.S.C. 154(b) by 42 days.

(21) Appl. No.: 16/344,236

(22) PCT Filed: Oct. 31, 2017

(86) PCT No.: PCT/EP2017/077903
§ 371 (c)(1),
(2) Date: Apr. 23, 2019

(87) PCT Pub. No.: WO2018/083093
PCT Pub. Date: May 11, 2018

(65) Prior Publication Data

US 2019/0264141 A1 Aug. 29, 2019

(30) Foreign Application Priority Data

Nov. 1, 2016 (EP) ..... 16196760

(51) Int. Cl.

| | |
|---|---|
| ***C11D 3/04*** | (2006.01) |
| ***C11D 3/12*** | (2006.01) |
| ***C11D 3/22*** | (2006.01) |
| ***C11D 3/24*** | (2006.01) |
| ***C11D 3/37*** | (2006.01) |
| ***C11D 3/386*** | (2006.01) |
| ***C11D 17/06*** | (2006.01) |
| ***C11D 3/38*** | (2006.01) |
| ***C11D 17/00*** | (2006.01) |

(52) U.S. Cl.
CPC ..... *C11D 3/38672* (2013.01); *C11D 3/046* (2013.01); *C11D 3/124* (2013.01); *C11D 3/126* (2013.01); *C11D 3/222* (2013.01); *C11D 3/3707* (2013.01); *C11D 3/3753* (2013.01); *C11D 3/3776* (2013.01); *C11D 3/381* (2013.01); *C11D 17/0039* (2013.01); *C11D 17/06* (2013.01)

(58) Field of Classification Search
CPC ..... C11D 3/04; C11D 3/046; C11D 3/048; C11D 3/12; C11D 3/122; C11D 3/1233; C11D 3/124; C11D 3/126; C11D 3/2065; C11D 3/22; C11D 3/24; C11D 3/37; C11D 3/381; C11D 3/386; C11D 3/38672; C11D 17/0039; C11D 17/06
See application file for complete search history.

(56) References Cited

U.S. PATENT DOCUMENTS

| | | | | |
|---|---|---|---|---|
| 4,242,219 | A | 12/1980 | Bogerman | |
| 5,846,798 | A | 12/1998 | Paatz | |
| 6,493,200 | B1 | 12/2002 | Farmer et al. | |
| 6,943,200 | B1 * | 9/2005 | Corrand | C11D 3/386 521/65 |
| 2005/0067726 | A1 | 3/2005 | Nianxi | |
| 2009/0156454 | A1 | 6/2009 | Schmiedel et al. | |
| 2009/0185645 | A1 | 6/2009 | Schmiedel et al. | |
| 2009/0291483 | A1 | 11/2009 | Bach | |
| 2012/0220514 | A1 * | 8/2012 | Fernandes | C11D 17/0039 510/337 |

FOREIGN PATENT DOCUMENTS

| | | | | |
|---|---|---|---|---|
| EP | 2674475 | A1 | 12/2013 | |
| ES | 2373994 | T3 | 2/2012 | |
| WO | 99/67320 | A1 | 12/1999 | |
| WO | 2003/000625 | A2 | 1/2003 | |
| WO | WO 03/000625 | * | 1/2003 | |
| WO | WO 2013/188331 | * | 12/2013 | C11D 3/386 |

OTHER PUBLICATIONS

Who et al, 1999, World health organization, 1-96.

* cited by examiner

*Primary Examiner* — Brian P Mruk
(74) *Attorney, Agent, or Firm* — Eric Fechter

(57) ABSTRACT

A granule comprising (a) at least three cores comprising a biological active and a plasticizable polymer, wherein the cores are made of a material having an elongation upon break of at least 30%, and wherein the diameter of the cores is at least 50 μm and at most two thirds of the diameter of the granule; (b) a solid matrix interspacing the cores of (a), wherein the solid matrix is made of a material having an elongation upon break of less than 30%; and (c) optionally a coating consisting of one or more layer(s) surrounding the granule. A detergent composition comprising a detergent builder, a surfactant, and a granule as described. Use of the granule as a component in a process for manufacturing a detergent composition.

15 Claims, No Drawings

MULTI-CORE GRANULES

CROSS-REFERENCE TO RELATED APPLICATIONS

This application is a 35 U.S.C. 371 national application of international application no. PCT/EP2017/077903 filed Oct. 31, 2017, which claims priority or the benefit under 35 U.S.C. 119 of European application no. 16196760.9 filed Nov. 1, 2016, the contents of which are fully incorporated herein by reference.

FIELD OF THE INVENTION

The present invention relates to granules containing a biological active, comprising multiple elastic cores in a non-elastic matrix. The granules exhibit reduced release of the biological active upon breakage of the granule after exposure to physical stress.

BACKGROUND

Compositions such as cleaning products, personal-care products, cosmetics and pharmaceuticals often comprise active ingredients which are required to be delivered in aqueous environments, but are sensitive to moisture, temperature changes, light and/or air during storage. These compositions often contain ingredients which may react with one another. Therefore, such ingredient are often protected or separated from one another by coating agents or encapsulating agents. For example enzymes, used in detergents, are often incompatible with alkaline or acid materials, bleaches, moisture and light, and are thus coated to protect them. Because the active materials generally need to be delivered in aqueous conditions, the coating materials need to be chosen such that the coating dissolve or disperse well in water. For example, enzymes may be coated with water-soluble coatings, such as starch-based materials.

A problem with many solid ingredients, in particular enzymes, is that they tend to form dust during physical handling, e.g., during processing in mixing and packaging machines, or even after crushing of spilled particles by equipment, shoes or wheels. This not only creates waste product, but the dust can also cause serious hygiene and health problems. In aerosol science, it is generally accepted that particles with an aerodynamic diameter >50 μm do not commonly remain airborne for very long. In this context, the aerodynamic diameter is defined as "the diameter of a hypothetical sphere of density 1 g/cm$^3$ having the same terminal settling velocity in calm air as the particle in question, regardless of its geometric size, shape and true density." (WHO, 1997).

Prior art formulations designed to improve the resistance of granules to impact and shear forces may include polymers as binders or coating agents. Plasticizers also may be added to improve the impact resistance of such granules; however, the use of plasticizers in granules and granule coatings is limited by their tendency to increase tackiness and agglomeration of formulations which incorporate polymers as coatings or binders.

In an effort to reduce dust formation, active ingredients have been formulated with materials such as PVA, HPMC or maltodextrins that are plasticized with, i.e., water, glycerol, PEG or mannitol to reduce brittleness of the product. Materials that may be deformed extensively without breaking into small fragments, which potentially release airborne enzyme particles, have to be non-crystalline and additionally in a so called rubbery state. The transition between the arrested ("frozen") glass state and the rubbery state is called the glass transition. It starts to occur at a characteristic temperature called the glass transitions temperature, Tg. The relation between the stickiness of a product and its temperature in relation to its Tg has been extensively studied. At a temperature above Tg the product is in the rubbery state and has the desired breakage properties, but it is also sticky which prevents the material to be processed in industrial relevant processes, such as spray dryers, fluid beds and extrusion processes, and be transformed into a final product, which would cake together and not be fit for the final use. Nevertheless, numerous techniques have been developed to produce these "sticky" formulations including prilling, extrusion, spheronization, drum granulation, and fluid bed spray coating.

In WO 99/67320 a process for preparing a highly stable plasticized polyvinyl alcohol gel is described. By putting formulated droplets on a surface and drying them, lens shaped product will be produced with a diameter >1 mm and a height between 0.1 and 1 mm. These elastic enzyme containing particles can be used in all kind of applications (i.e., chemical synthesis, waste water treatment).

Extrusion of thermoplastics with incorporation of active ingredients is similarly described in U.S. Pat. No. 4,242,219.

In U.S. Pat. No. 6,943,200, water unstable foam compositions are described, which are used to produce elastic foam particles in a range between 100 and 1500 μm.

These formulated products have all in common that the lower end of the particle size is limited by the chosen processes (extrusion, drying droplets on a belt). These processes are chosen to circumvent the difficulties with stickiness and agglomeration of particles that appear when producing particles of materials with a glass transition temperature below 100° C. or even lower.

SUMMARY OF THE INVENTION

The present invention provides, in a first aspect, a granule comprising (a) at least three cores comprising a biological active and a plasticizable polymer, wherein the cores are made of a material having an elongation upon break of at least 30%, and wherein the diameter of the cores is at least 50 μm and at most two thirds of the diameter of the granule;

(b) a solid matrix interspacing the cores of (a), wherein the solid matrix is made of a material having an elongation upon break of less than 30%; and (c) optionally a coating consisting of one or more layer(s) surrounding the granule.

The invention also provides methods for preparation of the granules and compositions comprising the granules, and uses thereof.

Other aspects and embodiments of the invention are apparent from the description and examples.

DETAILED DESCRIPTION

The present invention has solved these problems by distributing a multitude of small (but sufficiently large to prevent getting airborne) particles/cores having a Tg less than ambient temperatures into a brittle to semi-brittle granule, which will behave non-sticky as the matrix interspacing the cores is made of a non-plastic or crystalline material that by nature is non-sticky. This multicore concept has the advantage that when breaking the outer brittle matrix (the interspacing matrix), the inner multitude of particles/cores containing the enzyme will not break because they are plastic.

Not only are the granules less prone to release enzyme dust in their intended industrial application, but they are also safer to use during production of the granules—the size of the enzyme particles prevents them getting airborne—in for example high shear granulation, spray granulation, extrusion, prilling etc.

Further, separation of the enzyme in the cores from the interspacing matrix makes it possible to use chemicals in the interspacing matrix that would destabilize the enzyme if they were mixed together. Even further, the present invention describes a method involving simultaneous spray drying of the enzyme and a protecting layer, which is useful for the manufacture of enzyme cores having desired properties.

Definitions

The term "elongation upon break" is a property of the material of which the cores are made (the core material). Elongation upon break is defined as the maximum tensile strain or deformation which can be applied to a film made from the core material prior to breakage or failure. It is expressed as the percentage increase in length relative to the original length or gage length of a film sample made from the core material, prior to the application of tensile stress. Percent elongation depends on the gage length and is the increase in gage length measured after failure divided by the original gage length. Failure of the film is considered the point at which the film breaks. For the purpose of this invention a gage length of 50 mm is commonly used, although a gage length of 10 to 100 mm may also be used. For a discussion of elongation upon break and gage length, reference is made to L. Van Vlack, "Elements of Material Science and Engineering, 4th Ed. Addison-Wesley Publishing Company, 1980, pages 6-13.

Materials that may be deformed extensively without breaking into small fragments, which potentially release airborne enzyme particles, have to be non-crystalline and additionally in a so called rubbery state. The transition between the arrested ("frozen") glass state and the rubbery state is called the glass transition. It starts to occur at a characteristic temperature called the glass transitions temperature Tg. The relation between the stickiness of a product, temperature and Tg has been extensively studied. At a temperature above Tg the product is in the rubbery state and has the desired breakage properties, but it is also sticky which prevents the material from being processed in industrial relevant processes such as spray dryers, fluid beds and extrusion processes and be transformed into a final product, which would cake together and not be fit for the final use.

Biological Active

In the context of the present invention, a biological active is a compound or microorganism exhibiting a biological activity, for example, catalyzing a biochemical reaction or carrying out a biological process.

Preferred examples of biological actives are enzymes, and microorganisms such as bacterial spores.

Enzymes

The biological active may be one or more enzymes such as a protease, lipase, cutinase, an amylase, carbohydrase, cellulase, pectinase, mannanase, arabinase, galactanase, xylanase, DNase, perhydrolase, oxidase, e.g., a laccase, and/or peroxidase.

The enzyme may be a naturally occurring enzyme of bacterial or fungal origin, or it may be a variant derived from one or more naturally occurring enzymes by gene shuffling and/or by substituting, deleting or inserting one or more amino acids. Chemically modified or protein engineered mutants are included.

Preferably, the granule contains at least one enzyme in an amount of more than 0.5% w/w and less than 50% w/w active enzyme protein; more preferably in an amount of more than 0.6% w/w and less than 40% w/w active enzyme protein; more preferably in an amount of more than 0.75% w/w and less than 30% w/w active enzyme protein; and most preferably in an amount of more than 1% w/w and less than 25% w/w active enzyme protein.

Cellulases:

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. Nos. 4,435,307, 5,648,263, 5,691,178, 5,776,757 and WO 89/09259.

Especially suitable cellulases are the alkaline or neutral cellulases having colour care benefits. Examples of such cellulases are cellulases described in EP 0 495 257, EP 0 531 372, WO 96/11262, WO 96/29397, WO 98/08940. Other examples are cellulase variants such as those described in WO 94/07998, EP 0 531 315, U.S. Pat. Nos. 5,457,046, 5,686,593, 5,763,254, WO 95/24471, WO 98/12307 and PCT/DK98/00299.

Commercially available cellulases include Celluzyme™, Carezyme™, and Celluclean™ (Novozymes A/S), Clazinase™, and Puradax HA™ (Genencor International Inc.), and KAC-500(B)™ (Kao Corporation).

Proteases:

Suitable proteases include those of bacterial, fungal, plant, viral or animal origin, e.g., vegetable or microbial origin. Microbial origin is preferred. Chemically modified or protein engineered mutants are included. It may be an alkaline protease, such as a serine protease or a metalloprotease. A serine protease may for example be of the S1 family, such as trypsin, or the S8 family such as subtilisin. A metalloproteases protease may for example be a thermolysin from, e.g., family M4 or other metalloprotease, such as those from M5, M7 or M8 families.

The term "subtilases" refers to a sub-group of serine protease according to Siezen et al., Protein Engng. 4 (1991) 719-737 and Siezen et al. Protein Science 6 (1997) 501-523. Serine proteases are a subgroup of proteases characterized by having a serine in the active site, which forms a covalent adduct with the substrate. The subtilases may be divided into 6 sub-divisions, i.e., the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO09/021867, and subtilisin lentus, subtilisin Novo, subtilisin Carlsberg, *Bacillus licheniformis*, subtilisin BPN', subtilisin 309, subtilisin 147 and subtilisin 168 described in WO89/06279 and protease PD138 described in WO93/18140. Other useful proteases may be those described in WO92/175177, WO01/016285, WO02/026024 and WO02/016547. Examples of trypsin-like proteases are trypsin (e.g., of porcine or bovine origin) and the *Fusarium* protease described in WO89/06270, WO94/25583 and WO05/040372, and the chymotrypsin proteases derived from *Cellumonas* described in WO05/052161 and WO05/052146.

A further preferred protease is the alkaline protease from *Bacillus lentus* DSM 5483, as described for example in WO95/23221, and variants thereof which are described in WO92/21760, WO95/23221, EP1921147 and EP1921148.

Examples of metalloproteases are the neutral metalloprotease as described in WO07/044993 (Genencor Int.) such as those derived from *Bacillus amyloliquefaciens*.

Examples of useful proteases are the variants described in: WO92/19729, WO96/034946, WO98/20115, WO98/20116, WO99/011768, WO01/44452, WO03/006602, WO04/03186, WO04/041979, WO07/006305, WO11/036263, WO11/036264, especially the variants with substitutions in one or more of the following positions: 3, 4, 9, 15, 27, 36, 57, 68, 76, 87, 95, 96, 97, 98, 99, 100, 101, 102, 103, 104, 106, 118, 120, 123, 128, 129, 130, 160, 167, 170, 194, 195, 199, 205, 206, 217, 218, 222, 224, 232, 235, 236, 245, 248, 252 and 274 using the BPN' numbering. More preferred the subtilase variants may comprise the mutations: S3T, V4I, S9R, A15T, K27R, *36D, V68A, N76D, N87S,R, *97E, A98S, S99G,D,A, S99AD, S101G,M,R S103A, V104I,Y,N, S106A, G118V,R, H120D,N, N123S, S128L, P129Q, S130A, G160D, Y167A, R170S, A194P, G195E, V199M, V2051, L217D, N218D, M222S, A232V, K235L, Q236H, Q245R, N252K, T274A (using BPN' numbering).

Suitable commercially available protease enzymes include those sold under the trade names Alcalase™, Duralase™, Durazym™, Relase™, Relase™ Ultra, Savinase™, Savinase™ Ultra, Primase™, Polarzyme™ Kannase™, Liquanase™, Liquanase™ Ultra, Ovozyme™ Coronase™ Coronase™ Ultra, Neutrase™, Everlase™ and Esperase™ (Novozymes A/S), those sold under the tradename Maxatase™, Maxacal™, Maxapem™, Purafect™, Purafect Prime™ Preferenz™, Purafect MA™, Purafect Ox™ Purafect OxP™, Puramax™, Properase™, Effectenz™, FN2™, FN3™, FN4™, Excellase™ Opticlean™, Optimase™, and Excellenz™ P1000 (Danisco/DuPont), Axapem™ (Gist-Brocases N.V.), BLAP™ (sequence shown in FIG. 29 of U.S. Pat. No. 5,352,604) and variants hereof (Henkel AG), Lavergy™ (BASF), and KAP (*Bacillus alkalophilus* subtilisin) from Kao.

Lipases and Cutinases:

Suitable lipases and cutinases include those of bacterial or fungal origin. Chemically modified or protein engineered mutant enzymes are included. Examples include lipase from *Thermomyces*, e.g., from *T. lanuginosus* (previously named *Humicola lanuginosa*) as described in EP258068 and EP305216, cutinase from *Humicola*, e.g., *H. insolens* (WO96/13580), lipase from strains of *Pseudomonas* (some of these now renamed to *Burkholderia*), e.g., *P. alcaligenes* or *P. pseudoalcaligenes* (EP218272), *P. cepacia* (EP331376), P. sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca* (WO11/084412), *Geobacillus stearothermophilus* lipase (WO11/084417), lipase from *Bacillus subtilis* (WO11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include Lipolase™, Lipex™ Lipolex™ and Lipoclean™ (Novozymes A/S), Lumafast™ (originally from Genencor) and Lipomax™ (originally from Gist-Brocades).

Still other examples are lipases sometimes referred to as acyltransferases or perhydrolases, e.g., acyltransferases with homology to *Candida antarctica* lipase A (WO10/111143), acyltransferase from *Mycobacterium smegmatis* (WO05/56782), perhydrolases from the CE 7 family (WO09/67279), and variants of the *M. smegmatis* perhydrolase in particular the S54V variant used in the commercial product Gentle Power Bleach from Huntsman Textile Effects Pte Ltd (WO10/100028).

Amylases:

Suitable amylases are alpha-amylases or glucoamylases and may be of bacterial or fungal origin. Chemically modified or protein engineered mutants are included. Amylases include, for example, alpha-amylases obtained from *Bacillus*, e.g., a special strain of *Bacillus licheniformis*, described in more detail in GB 1,296,839.

Suitable amylases include amylases having SEQ ID NO: 3 in WO 95/10603 or variants having 90% sequence identity to SEQ ID NO: 3 thereof. Preferred variants are described in WO 94/02597, WO 94/18314, WO 97/43424 and SEQ ID NO: 4 of WO 99/019467, such as variants with substitutions in one or more of the following positions: 15, 23, 105, 106, 124, 128, 133, 154, 156, 178, 179, 181, 188, 190, 197, 201, 202, 207, 208, 209, 211, 243, 264, 304, 305, 391, 408, and 444.

Different suitable amylases include amylases having SEQ ID NO: 6 in WO 02/010355 or variants thereof having 90% sequence identity to SEQ ID NO: 6. Preferred variants of SEQ ID NO: 6 are those having a deletion in positions 181 and 182 and a substitution in position 193. Other amylases which are suitable are hybrid alpha-amylase comprising residues 1-33 of the alpha-amylase derived from *B. amyloliquefaciens* shown in SEQ ID NO: 6 of WO 2006/066594 and residues 36-483 of the *B. licheniformis* alpha-amylase shown in SEQ ID NO: 4 of WO 2006/066594 or variants having 90% sequence identity thereof. Preferred variants of this hybrid alpha-amylase are those having a substitution, a deletion or an insertion in one of more of the following positions: G48, T49, G107, H156, A181, N190, M197, 1201, A209 and Q264. Most preferred variants of the hybrid alpha-amylase comprising residues 1-33 of the alpha-amylase derived from *B. amyloliquefaciens* shown in SEQ ID NO: 6 of WO 2006/066594 and residues 36-483 of SEQ ID NO: 4 are those having the substitutions:

M197T;

H156Y+A181T+N190F+A209V+Q264S; or

G48A+T49I+G107A+H156Y+A181T+N190F+I201F+A209V+Q264S.

Further amylases which are suitable are amylases having SEQ ID NO: 6 in WO 99/019467 or variants thereof having 90% sequence identity to SEQ ID NO: 6. Preferred variants of SEQ ID NO: 6 are those having a substitution, a deletion or an insertion in one or more of the following positions: R181, G182, H183, G184, N195, I206, E212, E216 and K269. Particularly preferred amylases are those having deletion in positions R181 and G182, or positions H183 and G184.

Additional amylases which can be used are those having SEQ ID NO: 1, SEQ ID NO: 3, SEQ ID NO: 2 or SEQ ID NO: 7 of WO 96/023873 or variants thereof having 90% sequence identity to SEQ ID NO: 1, SEQ ID NO: 2, SEQ ID NO: 3 or SEQ ID NO: 7. Preferred variants of SEQ ID NO: 1, SEQ ID NO: 2, SEQ ID NO: 3 or SEQ ID NO: 7 are those having a substitution, a deletion or an insertion in one or more of the following positions: 140, 181, 182, 183, 184, 195, 206, 212, 243, 260, 269, 304 and 476. More preferred variants are those having a deletion in positions 181 and 182 or positions 183 and 184. Most preferred amylase variants of SEQ ID NO: 1, SEQ ID NO: 2 or SEQ ID NO: 7 are those having a deletion in positions 183 and 184 and a substitution in one or more of positions 140, 195, 206, 243, 260, 304 and 476.

Other amylases which can be used are amylases having SEQ ID NO: 2 of WO 08/153815, SEQ ID NO: 10 in WO 01/66712 or variants thereof having 90% sequence identity to SEQ ID NO: 2 of WO 08/153815 or 90% sequence identity to SEQ ID NO: 10 in WO 01/66712. Preferred variants of SEQ ID NO: 10 in WO 01/66712 are those having a substitution, a deletion or an insertion in one of more of the following positions: 176, 177, 178, 179, 190, 201, 207, 211 and 264.

Further suitable amylases are amylases having SEQ ID NO: 2 of WO 09/061380 or variants having 90% sequence identity to SEQ ID NO: 2 thereof. Preferred variants of SEQ ID NO: 2 are those having a truncation of the C-terminus and/or a substitution, a deletion or an insertion in one of more of the following positions: Q87, Q98, S125, N128, T131, T165, K178, R180, S181, T182, G183, M201, F202, N225, S243, N272, N282, Y305, R309, D319, Q320, Q359, K444 and G475. More preferred variants of SEQ ID NO: 2 are those having the substitution in one of more of the following positions: Q87E,R, Q98R, S125A, N128C, T131I, T165I, K178L, T182G, M201L, F202Y, N225E,R, N272E, R, S243Q,A,E,D, Y305R, R309A, Q320R, Q359E, K444E and G475K and/or deletion in position R180 and/or S181 or of T182 and/or G183. Most preferred amylase variants of SEQ ID NO: 2 are those having the substitutions:
N128C+K178L+T182G+Y305R+G475K;
N128C+K178L+T182G+F202Y+Y305R+D319T+G475K;
S125A+N128C+K178L+T182G+Y305R+G475K; or
S125A+N128C+T131I+T165I+K178L+T182G+Y305R+G475K wherein the variants are C-terminally truncated and optionally further comprises a substitution at position 243 and/or a deletion at position 180 and/or position 181.

Other suitable amylases are the alpha-amylase having SEQ ID NO: 12 in WO01/66712 or a variant having at least 90% sequence identity to SEQ ID NO: 12. Preferred amylase variants are those having a substitution, a deletion or an insertion in one of more of the following positions of SEQ ID NO: 12 in WO01/66712: R28, R118, N174; R181, G182, D183, G184, G186, W189, N195, M202, Y298, N299, K302, S303, N306, R310, N314; R320, H324, E345, Y396, R400, W439, R444, N445, K446, Q449, R458, N471, N484. Particular preferred amylases include variants having a deletion of D183 and G184 and having the substitutions R118K, N195F, R320K and R458K, and a variant additionally having substitutions in one or more position selected from the group: M9, G149, G182, G186, M202, T257, Y295, N299, M323, E345 and A339, most preferred a variant that additionally has substitutions in all these positions.

Other examples are amylase variants such as those described in WO2011/098531, WO2013/001078 and WO2013/001087.

Commercially available amylases are Duramyl™, Termamyl™, Fungamyl™ Stainzyme™, Stainzyme Plus™, Natalase™, Liquozyme X and BAN™ (from Novozymes A/S), and Rapidase™, Purastar™/Effectenz™, Powerase™ and Preferenz™ S100 (from Genencor International Inc./DuPont).

Lyase:

The lyase may be a pectate lyase of bacterial or fungal origin. Chemically or genetically modified mutants are included. In a preferred embodiment the pectate lyase is derived from *Bacillus*, particularly *Bacillus substilis, B. lichemiformis or B. agaradhaerens*, or a variant derived of any of these, e.g. as described in U.S. Pat. No. 6,124,127, WO 1999/027083, WO 1999/027084, WO 2002/006442, WO 2002/092741, WO 2003/095638, Commercially available pectate lyases include XPect; Pectawash and Pectaway (Novozymes A/S).

Mannanase:

Suitable mannanases include those of bacterial or fungal origin. Chemically or genetically modified mutants are included. The mannanase may be an alkaline mannanase of Family 5 or 26. It may be a wild-type from *Bacillus* or *Humicola*, particularly *B. agaradhaerens, B. licheniformis, B. halodurans, B. clausii*, or *H. insolens*. Suitable mannanases are described in WO 1999/064619. A commercially available mannanase is Mannaway™ (Novozymes A/S).

Deoxyribonuclease (DNase):

Suitable deoxyribonucleases (DNases) are any enzyme that catalyzes the hydrolytic cleavage of phosphodiester linkages in the DNA backbone, thus degrading DNA. According to the invention, a DNase which is obtainable from a bacterium is preferred; in particular a DNase which is obtainable from a *Bacillus* is preferred; in particular a DNase which is obtainable from *Bacillus subtilis* or *Bacillus licheniformis* is preferred. Examples of such DNases are described in patent application WO 2011/098579 or in PCT/EP2013/075922.

Perhydrolases:

Suitable perhydrolases are capable of catalyzing a perhydrolysis reaction that results in the production of a peracid from a carboxylic acid ester (acyl) substrate in the presence of a source of peroxygen (e.g., hydrogen peroxide). While many enzymes perform this reaction at low levels, perhydrolases exhibit a high perhydrolysis:hydrolysis ratio, often greater than 1. Suitable perhydrolases may be of plant, bacterial or fungal origin. Chemically modified or protein engineered mutants are included.

Examples of useful perhydrolases include naturally occurring *Mycobacterium* perhydrolase enzymes, or variants thereof. An exemplary enzyme is derived from *Mycobacterium smegmatis*. Such enzyme, its enzymatic properties, its structure, and variants thereof, are described in WO 2005/056782, WO 2008/063400, US 2008/145353, and US2007167344.

Peroxidases/Oxidases:

Suitable peroxidases are comprised by the enzyme classification EC 1.11.1.7, as set out by the Nomenclature Committee of the International Union of Biochemistry and Molecular Biology (IUBMB), or any fragment derived therefrom, exhibiting peroxidase activity.

Suitable peroxidases include those of plant, bacterial or fungal origin. Chemically modified or protein engineered mutants are included. Examples of useful peroxidases include peroxidases from *Coprinopsis*, e.g., from *C. cinerea* (EP 179,486), and variants thereof as those described in WO 93/24618, WO 95/10602, and WO 98/15257.

The peroxidases also include a haloperoxidase enzyme, such as chloroperoxidase, bromoperoxidase and compounds exhibiting chloroperoxidase or bromoperoxidase activity. Haloperoxidases are classified according to their specificity for halide ions. Chloroperoxidases (E.C. 1.11.1.10) catalyze formation of hypochlorite from chloride ions.

In an embodiment, the haloperoxidase of the invention is a chloroperoxidase. Preferably, the haloperoxidase is a vanadium haloperoxidase, i.e., a vanadate-containing haloperoxidase. In a preferred method of the present invention the vanadate-containing haloperoxidase is combined with a source of chloride ion.

Haloperoxidases have been isolated from many different fungi, in particular from the fungus group dematiaceous hyphomycetes, such as *Caldariomyces*, e.g., *C. fumago, Alternaria, Curvularia*, e.g., *C. verruculosa* and *C. inaequalis, Drechslera, Ulocladium* and *Botrytis.*

Haloperoxidases have also been isolated from bacteria such as *Pseudomonas*, e.g., *P. pyrrocinia* and *Streptomyces*, e.g., *S. aureofaciens.*

In an preferred embodiment, the haloperoxidase is derivable from *Curvularia* sp., in particular *Curvularia verruculosa* or *Curvularia inaequalis*, such as *C. inaequalis* CBS 102.42 as described in WO 95/27046; or *C. verruculosa* CBS 147.63 or *C. verruculosa* CBS 444.70 as described in WO 97/04102; or from *Drechslera hartlebii* as described in WO 01/79459, *Dendryphiella salina* as described in WO 01/79458, *Phaeotrichoconis crotalarie* as described in WO 01/79461, or *Geniculosporium* sp. as described in WO 01/79460.

Suitable oxidases include, in particular, any laccase enzyme comprised by the enzyme classification EC 1.10.3.2, or any fragment derived therefrom exhibiting laccase activity, or a compound exhibiting a similar activity, such as a catechol oxidase (EC 1.10.3.1), an o-aminophenol oxidase (EC 1.10.3.4), or a bilirubin oxidase (EC 1.3.3.5).

Preferred laccase enzymes are enzymes of microbial origin. The enzymes may be derived from plants, bacteria or fungi (including filamentous fungi and yeasts).

Suitable examples from fungi include a laccase derivable from a strain of *Aspergillus, Neurospora*, e.g., *N. crassa, Podospora, Botrytis, Collybia, Fomes, Lentinus, Pleurotus, Trametes*, e.g., *T. villosa* and *T. versicolor, Rhizoctonia*, e.g., *R. solani, Coprinopsis*, e.g., *C. cinerea, C. comatus, C. friesii*, and *C. plicatilis, Psathyrella*, e.g., *P. condelleana, Panaeolus*, e.g., *P. papilionaceus, Myceliophthora*, e.g., *M. thermophila, Schytalidium*, e.g., *S. thermophilum, Polyporus*, e.g., *P. pinsitus, Phiebia*, e.g., *P. radiata* (WO 92/01046), or *Coriolus*, e.g., *C. hirsutus* (JP 2238885).

Suitable examples from bacteria include a laccase derivable from a strain of *Bacillus*. A laccase derived from *Coprinopsis* or *Myceliophthora* is preferred; in particular a laccase derived from *Coprinopsis cinerea*, as disclosed in WO 97/08325; or from *Myceliophthora thermophila*, as disclosed in WO 95/33836.

Microorganisms

The biological active may be one or more microorganisms, such as one or more fungi, yeast, or bacteria. In a preferred embodiment, the one or more microorganisms are dehydrated bacteria or yeast.

In a particular embodiment, the biological active is one or more microbial spores (as opposed to vegetative cells), such as bacterial spores; or fungal spores, conidia, hypha. Preferably, the one or more spores are *Bacillus* endospores; even more preferably the one or more spores are endospores of *Bacillus subtilis, Bacillus licheniformis, Bacillus amyloliquefaciens*, and/or *Bacillus megaterium.*

Granule

The granule of the invention is a small particle containing a biological active.

The granule comprises of at least three cores, a solid matrix interspacing the cores, and optionally one or more coatings (outer layers) surrounding the granule.

The solid matrix interspacing the cores is made of a material having an elongation upon break of less than 30%, preferably less than 20%, more preferably less than 10%, more preferably less than 5%, and in particular less than 1%.

In a preferred embodiment, the solid matrix interspacing the cores comprises at least 50% w/w of a crystalline material, preferably at least 70%, or at least 90% w/w of a crystalline material. In a particular embodiment, the solid matrix interspacing the cores essentially consists of a crystalline material. The crystalline material may include impurities that do not affect the crystalline properties of the material.

The granule typically has a (weight/volume average) diameter of 100-2000 μm, preferably 200-2000 μm, more preferably 200-1500 μm. The granule may be (roughly) spherical.

In an embodiment, the granule includes less than 10% w/w surfactant, or less than 5% w/w surfactant, or less than 2% w/w surfactant, or less than 1% w/w surfactant. Preferably, the surfactant is a laundry detergent surfactant.

In another embodiment, the granule does not include a surfactant, a detergent builder, and/or a bleaching agent.

Crystalline Material

A crystalline material, as used in the context of the invention, is a material which does not exhibit a glass transition with glycerol (e.g., as a 50:50% w/w mixture with glycerol and measured by DSC); thus the crystalline material is not plasticized by glycerol. Examples of crystalline materials are silicates, e.g., micas; or clays like kaolin, smectite, bentonite and talc; or inorganic salts like alkali metal sulfates, carbonates, nitrates and halides; alkaline earth metal sulfates, carbonates, nitrates and halides; transition metal sulfates, carbonates, nitrates and halides; and ammonium sulfates, carbonates, nitrates and halides; e.g., $Na_2SO_4$, K2SO$_4$, $CaSO_4$, $MgSO_4$, $ZnSO_4$, $(NH_4)_2SO_4$, $Na_2CO_3$, $NaHCO_3$, $K_2CO_3$, $KHCO_3$, $CaCO_3$, $MgCO_3$, $ZnCO_3$, $(NH_4)_2CO_3$, $NaNO_3$, $KNO_3$, $Ca(NO_3)_2$, $Mg(NO_3)_2$, $Zn(NO_3)_2$, $NH_4NO_3$, NaCl, KCl, $CaCl_2$), $MgCl_2$, $ZnCl_2$, and $NH_4Cl$; or crystals like citrates, e.g., sodium or potassium citrate. Included are also the hydrates thereof.

Cores

The cores comprised in the granule of the invention are made of a material ("core material") comprising a biological active, which material has an elongation upon break of at least 30%.

The cores comprise a plasticizable polymer or polymeric material, and optionally also a plasticizer.

A plasticizable polymeric material, as used in the context of the invention, is a material which exhibits a glass transition with glycerol (e.g., as a 50:50% w/w mixture with glycerol and measured by DSC); thus, the plasticizable polymeric material is not a crystalline material.

In an embodiment, the cores comprise at least 50% w/w of the plasticizable polymeric material; more preferably the cores comprise at least 70% w/w of the plasticizable polymeric material; and most preferably the cores comprise at least 90% w/w of the plasticizable polymeric material.

The core material may include other granulation material(s) such as binder (e.g., synthetic polymer, wax, fat, or carbohydrate) filler, fibre material (cellulose or synthetic fibres), stabilizing agent, solubilizing agent, suspension agent, viscosity regulating agent, light spheres, plasticizer, salt, lubricant, and/or fragrance.

The biological active is present in the core material as a substantially homogenous composition. More specifically, the biological active and the rest of the core material components are not separated, compartmentalized or arranged in discrete layers.

The cores may comprise a salt of a multivalent cation, a reducing agent, an antioxidant, a peroxide decomposing catalyst and/or an acidic buffer component, typically as a homogenous blend.

The cores have a diameter of more than 50 μm and less than two thirds of the diameter of the granule, preferably less than half of the diameter of the granule, particularly 50-1000 μm. Preferably, the cores have a diameter of 50-800 μm, 50-600 μm, or 50-400 μm.

Plasticizable Polymer

The core material is made from a water-soluble or water dispersible plasticizable polymer or polymeric material having an elongation upon break value of greater than about 30 percent; greater than 50 percent, greater than 100 percent, greater than 125 percent, greater than 150 percent, or greater than 200 percent. The percent elongation upon break is the most significant property of the core material, as it is a measure of the elasticity and dust retention properties of the cores of the invention. Elongation upon break may be measured by use of a stress/strain device such as manufactured by Instron (Canton Mass.).

For the purpose of the present invention, elongation upon break of a core material is measured on a test film made from the core material. In one embodiment, an Instron stress/strain test is used to determine the elongation of a test film. In this test, a test film is held in place between two jaws under pneumatic pressure. A constant strain rate is applied to the film while the stress on the film is measured and recorded by a load cell. American Society for Testing and Materials (ASTM) methods known to those in the art teach how to make these measurements. Preferably, the test method is ASTM D882 (Standard Test Method for Tensile Properties of Thin Plastic Sheeting); specifically ASTM D882-10.

To use the stress/strain device, a film of uniform thickness is prepared by the method of casting, for example by spin coating, a polymer solution onto a plate such as a stainless steel or glass plate followed by drying and removing the film from the plate. The test film can also be prepared by the method of spray-coating, for example by atomizing a polymer solution onto a plate such as stainless steel or glass plate followed by drying and removal of the film. The film is cut into samples, for example, into samples of approximately 25 mm in width and 70 mm in length. The film thickness may then be measured using a digital coating thickness gauge and is an average of a number of measurements along the length of the film.

While one skilled in the art is aware of water-soluble polymers and water dispersible polymers, in general a water-soluble polymer will have a solubility of at least 1 percent, preferably at least 5 percent, and frequently at least 15 percent in deionized water at room temperature. Water dispersible polymers are those which break up into fine particles of no greater than about 50 microns at room temperature within about 10 minutes of moderate agitation in deionized water or a solution of less than about 5 percent of a detergent or nonionic surfactant. Moderate agitation may be achieved for example by use of a stir bar at 200 rpm in a 200 ml beaker filled to 100 ml with aqueous solvent.

Preferred non-limiting plasticizable polymers are selected from polyvinyl alcohols (PVA), polyethylene glycols (PEG), polyethylene oxides (PEO), polyvinyl pyrrolidones (PVP), cellulose ethers, alginates, gelatin, modified starches and substituted derivatives, hydrolysates and copolymers thereof. Most preferred polymers are PVA, cellulose ethers, such as methyl cellulose and hydroxylpropyl cellulose, gelatin and modified starches, such as hyproxypropyl starch produced from corn starch. Mostly preferred is PVA, however, it is not intended that the present invention be limited to any particular polymer. If PVA is used, in preferred embodiment the polymer has a level of hydrolysis in the range of about 50 to 99 percent, at least about 80 percent, at least about 85 percent, at least about 90 percent, and at least about 95 percent. The polymer may have an average molecular weight of about 4,000 to 250,000, preferably from 5,000 to 200,000; also from 10,000 to 100,000. For the purpose of the invention, a polymer of the core material may have a suitable viscosity below about 2000 cps, below 1000 cps and even below 500 cps at a temperature range of about 25 to 90 degrees centigrade. For the casting process step herein the viscosity is preferably 2000 cps or lower. Suitable polymers also include natural and synthetic gelling agents. Nonlimiting examples include hydrocolloids or gums, such as gelatin, pectin, carrageenan, xanthan gum, alginate, agarose, or any combination thereof. These gelling agents may also be combined with the polymers as listed above. A gelling agent may comprise about 1 to 10 percent, about 2 to 8 percent, or about 4 to 6 percent of the core material. In a preferred embodiment the core material comprises PVA.

Further, cross linking agents may be added to gel or modify the properties of the core material and reduce or delay its solubility, for example boric acid may be used to cross link PVA and calcium salts may be used to cross link sodium alginate.

Plasticizer

In a further embodiment, the plasticizable polymer may be mixed with a plasticizer to form the core material according to the invention. Suitable plasticizers are non-volatile solvents which may increase elongation upon break and thereby reducing the brittleness and enhancing deformability and dust retention properties of the cores. Typically plasticizers are low molecular weight organic compounds generally with molecular weights below 1000. Examples include, but are not limited to, polyols (polyhydric alcohols), for example alcohols with many hydroxyl groups such as glycerol, ethylene glycol, propylene glycol, dipropylene glycol, polyethylene glycol, polar low molecular weight organic compounds, such as urea, sugars, sugar alcohols, oxa diacids, diglycolic acids, and other linear carboxylic acids with at least one ether group, dibutyl or dimethyl phthalate. Sugars may include but are not limited to sucrose, dextrose, fructose, maltose, trehalose, and raffinose. Sugar alcohols that may serve as plasticizers include sorbitol, xylitol, and maltitol. Also included are wax, ethanolacetamide, ethanolformamide, triethanolamine acetate, sodium thiocyanates, and ammonium thiocyanates. Most preferred are glycerol, propylene glycol, sorbitol, and polyethylene glycol having an average molecular weight below about 800. The plasticizer is preferably present at a level of 1 to 75 percent by weight of the film forming polymer, preferably about 5 to 50 percent by weight of the polymer. The exact level will depend on the polymeric material and plasticizer comprising the cores. For example when glycerol is used as a plasticizer for a gelatin core material, the level is preferably about 20 to 50 percent by weight of the polymer.

Preparation of Core

The core can be prepared by granulating a blend of the ingredients, e.g., by a method comprising granulation techniques such as crystallization, precipitation, pan-coating, fluid bed coating, fluid bed agglomeration, rotary atomization, extrusion, prilling, spheronization, size reduction methods, drum granulation, and/or high shear granulation.

Methods for preparing the core can be found in Handbook of Powder Technology; Particle size enlargement by C. E. Capes; Volume 1; 1980; Elsevier. Preparation methods include known feed and granule formulation technologies, e.g.:

a) Spray dried products, wherein a liquid enzyme-containing solution is atomized in a spray drying tower to form small droplets which during their way down the drying tower dry to form an enzyme-containing particulate material. Very small particles can be produced this way (Michael S. Showell (editor); *Powdered detergents*; Surfactant Science Series; 1998; vol. 71; page 140-142; Marcel Dekker).

b) Layered products, wherein the enzyme is coated as a layer around a pre-formed inert core particle, wherein an enzyme-containing solution is atomized, typically in a fluid bed apparatus wherein the pre-formed core particles are fluidized, and the enzyme-containing solution adheres to the core particles and dries up to leave a layer of dry enzyme on the surface of the core particle. Particles of a desired size can be obtained this way if a useful core particle of the desired size can be found. This type of product is described in, e.g., WO 97/23606 c) Absorbed core particles, wherein rather than coating the enzyme as a layer around the core, the enzyme is absorbed onto and/or into the surface of the core. Such a process is described in WO 97/39116.

d) Extrusion or pelletized products, wherein an enzyme-containing paste is pressed to pellets or under pressure is extruded through a small opening and cut into particles which are subsequently dried. Such particles usually have a considerable size because of the material in which the extrusion opening is made (usually a plate with bore holes) sets a limit on the allowable pressure drop over the extrusion opening. Also, very high extrusion pressures when using a small opening increase heat generation in the enzyme paste, which is harmful to the enzyme (see also Michael S. Showell (editor); *Powdered detergents*; Surfactant Science Series; 1998; vol. 71; page 140-142; Marcel Dekker).

e) Prilled products, wherein an enzyme-containing powder is suspended in molten wax and the suspension is sprayed, e.g., through a rotating disk atomiser, into a cooling chamber where the droplets quickly solidify (Michael S. Showell (editor); *Powdered detergents*; Surfactant Science Series; 1998; vol. 71; page 140-142; Marcel Dekker). The product obtained is one wherein the enzyme is uniformly distributed throughout an inert material instead of being concentrated on its surface. Also U.S. Pat. Nos. 4,016,040 and 4,713,245 are documents relating to this technique f) Mixer granulation products, wherein a liquid is added to a dry powder composition of, e.g., conventional granulating components, the enzyme being introduced either via the liquid or the powder or both. The liquid and the powder are mixed and as the moisture of the liquid is absorbed in the dry powder, the components of the dry powder will start to adhere and agglomerate and particles will build up, forming granulates comprising the enzyme. Such a process is described in U.S. Pat. No. 4,106,991 and related documents EP 170360, EP 304332, EP 304331, WO 90/09440 and WO 90/09428. In a particular product of this process wherein various high-shear mixers can be used as granulators, granulates consisting of enzyme as enzyme, fillers and binders etc. are mixed with cellulose fibres to reinforce the particles to give the so-called T-granulate. Reinforced particles, being more robust, release less enzymatic dust.

g) Size reduction, wherein the cores are produced by milling or crushing of larger particles, pellets, tablets, briquettes etc. containing the enzyme. The wanted core particle fraction is obtained by sieving the milled or crushed product. Over and undersized particles can be recycled. Size reduction is described in (Martin Rhodes (editor); Principles of Powder Technology; 1990; Chapter 10; John Wiley & Sons).

h) Fluid bed granulation. Fluid bed granulation involves suspending particulates in an air stream and spraying a liquid onto the fluidized particles via nozzles. Particles hit by spray droplets get wetted and become tacky. The tacky particles collide with other particles and adhere to them and form a granule.

i) The cores may be subjected to drying, such as in a fluid bed drier. Other known methods for drying granules in the feed or detergent industry can be used by the skilled person. The drying preferably takes place at a product temperature of from 25 to 90° C. For some enzymes it is important the cores comprising the enzyme contain a low amount of water before coating. If water sensitive enzymes are coated before excessive water is removed, it will be trapped within the core and it may affect the activity of the enzyme negatively. After drying, the cores preferably contain 0.1-10% w/w water.

Coating

The granule may optionally be surrounded by at least one coating, e.g., to improve the storage stability, to reduce dust formation during handling, or for coloring the granule. The optional coating(s) may include a salt coating, or other suitable coating materials, such as polyethylene glycol (PEG), methyl hydroxy-propyl cellulose (MHPC) and polyvinyl alcohol (PVA). Examples of enzyme granules with multiple coatings are shown in WO 93/07263 and WO 97/23606.

The coating may be applied in an amount of at least 0.1% by weight of the core, e.g., at least 0.5%, 1% or 5%. The amount may be at most 100%, 70%, 50%, 40% or 30%.

The coating is preferably at least 0.1 μm thick, particularly at least 0.5 μm, at least 1 μm or at least 5 μm. In a particular embodiment the thickness of the coating is below 100 μm. In a more particular embodiment the thickness of the coating is below 60 μm. In an even more particular embodiment the total thickness of the coating is below 40 μm.

The coating should encapsulate the core unit by forming a substantially continuous layer. A substantially continuous layer is to be understood as a coating having few or no holes, so that the core unit it is encapsulating/enclosing has few or none uncoated areas. The layer or coating should in particular be homogeneous in thickness.

The coating can further contain other materials as known in the art, e.g., fillers, anti-sticking agents, pigments, dyes, plasticizers and/or binders, such as titanium dioxide, kaolin, calcium carbonate or talc.

A salt coating may comprise at least 60% by weight w/w of a salt, e.g., at least 65%, at least 70%, at least 75%, at least 80%, at least 85%, at least 90%, at least 95% or at least 99% by weight w/w.

The salt may be added from a salt solution where the salt is completely dissolved or from a salt suspension wherein the fine particles is less than 50 μm, such as less than 10 μm or less than 5 μm.

The salt coating may comprise a single salt or a mixture of two or more salts. The salt may be water soluble, in particular having a solubility at least 0.1 grams in 100 g of water at 20° C., preferably at least 0.5 g per 100 g water, e.g., at least 1 g per 100 g water, e.g., at least 5 g per 100 g water.

The salt may be an inorganic salt, e.g., salts of sulfate, sulfite, phosphate, phosphonate, nitrate, chloride or carbonate or salts of simple organic acids (less than 10 carbon atoms, e.g., 6 or less carbon atoms) such as citrate, malonate or acetate. Examples of cations in these salts are alkali or earth alkali metal ions, the ammonium ion or metal ions of the first transition series, such as sodium, potassium, magnesium, calcium, zinc or aluminium. Examples of anions include chloride, bromide, iodide, sulfate, sulfite, bisulfite, thiosulfate, phosphate, monobasic phosphate, dibasic phosphate, hypophosphite, dihydrogen pyrophosphate, tetraborate, borate, carbonate, bicarbonate, metasilicate, citrate, malate, maleate, malonate, succinate, lactate, formate, acetate, butyrate, propionate, benzoate, tartrate, ascorbate or gluconate. In particular alkali- or earth alkali metal salts of sulfate, sulfite, phosphate, phosphonate, nitrate, chloride or carbonate or salts of simple organic acids such as citrate, malonate or acetate may be used.

The salt in the coating may have a constant humidity at 20° C. above 60%, particularly above 70%, above 80% or above 85%, or it may be another hydrate form of such a salt (e.g., anhydrate). The salt coating may be as described in WO 00/01793 or WO 2006/034710.

Specific examples of suitable salts are NaCl ($CH_{20°}$ C.=76%), $Na_2CO_3$ ($CH_{20°}$ C.=92%), $NaNO_3$ ($CH_{20°}$ C.=73%), $Na_2HPO_4$ ($CH_{20°}$ C.=95%), $Na_3PO_4$ ($CH_{25°}$ C.=92%), $NH_4Cl$ ($CH_{20°}$ C.=79.5%), $(NH_4)_2HPO_4$ ($CH_{20°}$ C.=93.0%), $NH_4H_2PO_4$ ($CH_{20°}$ C.=93.1%), $(NH_4)_2SO_4$ ($CH_{20°}$ C.=81.1%), KCl ($CH_{20°}$ C.=85%), $K_2HPO_4$ ($CH_{20°}$ C.=92%), $KH_2PO_4$($CH_{20°}$ C.=96.5%), $KNO_3$ ($CH_{20°}$ C.=93.5%), $Na_2SO_4$($CH_{20°}$ C.=93%), $K_2SO_4$($CH_{20°}$ C.=98%), $KHSO_4$ ($CH_{20°}$ C.=86%), $MgSO_4$ ($CH_{20°}$ C.=90%), $ZnSO_4$ ($CH_{20°}$ C.=90%) and sodium citrate ($CH_{25°}$ C.=86%). Other examples include $NaH_2PO_4$, $(NH_4)H_2PO_4$, $CuSO_4$, $Mg(NO_3)_2$ and magnesium acetate.

The salt may be in anhydrous form, or it may be a hydrated salt, i.e. a crystalline salt hydrate with bound water(s) of crystallization, such as described in WO 99/32595. Specific examples include anhydrous sodium sulfate ($Na_2SO_4$), anhydrous magnesium sulfate ($MgSO_4$), magnesium sulfate heptahydrate ($MgSO_4.7H_2O$), zinc sulfate heptahydrate ($ZnSO_4.7H_2O$), sodium phosphate dibasic heptahydrate ($Na_2HPO_4.7H_2O$), magnesium nitrate hexahydrate ($Mg(NO_3)_2(6H_2O)$), sodium citrate dihydrate and magnesium acetate tetrahydrate.

Preferably the salt is applied as a solution of the salt, e.g., using a fluid bed.

Detergent Composition

The granule of the invention may be added to and thus become a component of a detergent composition. When used in a detergent composition, the biological active of the granule is preferably a (detergent) enzyme or a bacterial spore.

The detergent composition of the present invention may be formulated, for example, as a hand or machine laundry detergent composition including a laundry additive composition suitable for pre-treatment of stained fabrics and a rinse added fabric softener composition, or be formulated as a detergent composition for use in general household hard surface cleaning operations, or be formulated for hand or machine dishwashing operations.

In a specific aspect, the present invention provides a detergent additive comprising a granule of the present invention, as described herein.

In one embodiment, the invention is directed to detergent compositions comprising a granule of the present invention in combination with one or more additional cleaning composition components. The choice of additional components is within the skill of the artisan and includes conventional ingredients, including the exemplary non-limiting components set forth below.

The choice of components may include, for textile care, the consideration of the type of textile to be cleaned, the type and/or degree of soiling, the temperature at which cleaning is to take place, and the formulation of the detergent product. Although components mentioned below are categorized by general header according to a particular functionality, this is not to be construed as a limitation, as a component may comprise additional functionalities as will be appreciated by the skilled artisan.

In one embodiment of the present invention, an enzyme containing granule of the invention may be added to a detergent composition in an amount corresponding to 0.001-200 mg of enzyme protein, such as 0.005-100 mg of enzyme protein, preferably 0.01-50 mg of enzyme protein, more preferably 0.05-20 mg of enzyme protein, even more preferably 0.1-10 mg of enzyme protein per liter of wash liquor.

Surfactants

The detergent composition may comprise one or more surfactants, which may be anionic and/or cationic and/or non-ionic and/or semi-polar and/or zwitterionic, or a mixture thereof. In a particular embodiment, the detergent composition includes a mixture of one or more nonionic surfactants and one or more anionic surfactants. The surfactant(s) is typically present at a level of from about 0.1% to 60% by weight, such as about 1% to about 40%, or about 3% to about 20%, or about 3% to about 10%. The surfactant(s) is chosen based on the desired cleaning application, and includes any conventional surfactant(s) known in the art. Any surfactant known in the art for use in detergents may be utilized.

When included therein the detergent will usually contain from about 1% to about 40% by weight, such as from about 5% to about 30%, including from about 5% to about 15%, or from about 20% to about 25% of an anionic surfactant. Non-limiting examples of anionic surfactants include sulfates and sulfonates, in particular, linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or soap, and combinations thereof.

When included therein the detergent will usually contain from about 0.1% to about 10% by weight of a cationic surfactant. Non-limiting examples of cationic surfactants include alklydimethylethanolamine quat (ADMEAQ), cetyltrimethylammonium bromide (CTAB), dimethyldistearylammonium chloride (DSDMAC), and alkylbenzyldimethylammonium, alkyl quaternary ammonium compounds, alkoxylated quaternary ammonium (AQA) compounds, and combinations thereof.

When included therein the detergent will usually contain from about 0.2% to about 40% by weight of a non-ionic surfactant, for example from about 0.5% to about 30%, in particular from about 1% to about 20%, from about 3% to about 10%, such as from about 3% to about 5%, or from about 8% to about 12%. Non-limiting examples of non-ionic surfactants include alcohol ethoxylates (AE or AEO), alcohol propoxylates, propoxylated fatty alcohols (PFA), alkoxylated fatty acid alkyl esters, such as ethoxylated and/or propoxylated fatty acid alkyl esters, alkylphenol ethoxylates (APE), nonylphenol ethoxylates (NPE), alkylpolyglycosides (APG), alkoxylated amines, fatty acid monoethanolamides (FAM), fatty acid diethanolamides (FADA), ethoxylated fatty acid monoethanolamides (EFAM), propoxylated fatty acid monoethanolamides (PFAM), polyhydroxy alkyl fatty acid amides, or N-acyl N-alkyl derivatives of glucosamine (glucamides, GA, or fatty acid glucamide, FAGA), as well as products available under the trade names SPAN and TWEEN, and combinations thereof.

When included therein the detergent will usually contain from about 0.1% to about 20% by weight of a semipolar surfactant. Non-limiting examples of semipolar surfactants include amine oxides (AO) such as alkyldimethylamineoxide, N-(coco alkyl)-N,N-dimethylamine oxide and N-(tallow-alkyl)-N,N-bis(2-hydroxyethyl)amine oxide, fatty acid alkanolamides and ethoxylated fatty acid alkanolamides, and combinations thereof.

When included therein the detergent will usually contain from about 0.1% to about 10% by weight of a zwitterionic surfactant. Non-limiting examples of zwitterionic surfactants include betaine, alkyldimethylbetaine, sulfobetaine, and combinations thereof.

Hydrotropes

A hydrotrope is a compound that solubilises hydrophobic compounds in aqueous solutions (or oppositely, polar substances in a non-polar environment). Typically, hydrotropes have both hydrophilic and a hydrophobic character (so-called amphiphilic properties as known from surfactants); however the molecular structure of hydrotropes generally do not favor spontaneous self-aggregation, see for example review by Hodgdon and Kaler (2007), Current Opinion in Colloid & Interface Science 12: 121-128. Hydrotropes do not display a critical concentration above which self-aggregation occurs as found for surfactants and lipids forming miceller, lamellar or other well defined meso-phases. Instead, many hydrotropes show a continuous-type aggregation process where the sizes of aggregates grow as concentration increases. However, many hydrotropes alter the phase behavior, stability, and colloidal properties of systems containing substances of polar and non-polar character, including mixtures of water, oil, surfactants, and polymers. Hydrotropes are classically used across industries from pharma, personal care, food, to technical applications. Use of hydrotropes in detergent compositions allow for example more concentrated formulations of surfactants (as in the process of compacting liquid detergents by removing water) without inducing undesired phenomena such as phase separation or high viscosity.

The detergent may contain 0-5% by weight, such as about 0.5 to about 5%, or about 3% to about 5%, of a hydrotrope. Any hydrotrope known in the art for use in detergents may be utilized. Non-limiting examples of hydrotropes include sodium benzene sulfonate, sodium p-toluene sulfonate (STS), sodium xylene sulfonate (SXS), sodium cumene sulfonate (SCS), sodium cymene sulfonate, amine oxides, alcohols and polyglycolethers, sodium hydroxynaphthoate, sodium hydroxynaphthalene sulfonate, sodium ethylhexyl sulfate, and combinations thereof.

Builders and Co-Builders

The detergent composition may contain about 0-65% by weight, such as about 5% to about 50% of a detergent builder or co-builder, or a mixture thereof. In a dish wash detergent, the level of builder is typically 40-65%, particularly 50-65%. The builder and/or co-builder may particularly be a chelating agent that forms water-soluble complexes with calcium and magnesium ions. Any builder and/or co-builder known in the art for use in laundry detergents may be utilized. Non-limiting examples of builders include citrates, zeolites, diphosphates (pyrophosphates), triphosphates such as sodium triphosphate (STP or STPP), carbonates such as sodium carbonate, soluble silicates such as sodium metasilicate, layered silicates (e.g., SKS-6 from Hoechst), ethanolamines such as 2-aminoethan-1-ol (MEA), diethanolamine (DEA, also known as iminodiethanol), triethanolamine (TEA, also known as 2,2',2"-nitrilotriethanol), and carboxymethyl inulin (CMI), and combinations thereof.

The detergent composition may also contain 0-50% by weight, such as about 5% to about 30%, of a detergent co-builder, or a mixture thereof. The detergent composition may include a co-builder alone, or in combination with a builder, for example a zeolite builder. Non-limiting examples of co-builders include homopolymers of polyacrylates or copolymers thereof, such as poly(acrylic acid) (PAA) or copoly(acrylic acid/maleic acid) (PAA/PMA). Further non-limiting examples include citrate, chelators such as aminocarboxylates, aminopolycarboxylates and phosphonates, and alkyl- or alkenylsuccinic acid. Additional specific examples include 2,2',2"-nitrilotriacetic acid (NTA), ethylenediaminetetraacetic acid (EDTA), diethylenetriaminepentaacetic acid (DTPA), iminodisuccinic acid (IDS), ethylenediamine-N,N'-disuccinic acid (EDDS), methylglycinediacetic acid (MGDA), glutamic acid-N,N-diacetic acid (GLDA), 1-hydroxyethane-1,1-diphosphonic acid (HEDP), ethylenediaminetetra(methylenephosphonic acid) (EDTMPA), diethylenetriaminepentakis(methylenephosphonic acid) (DTMPA or DTPMPA), N-(2-hydroxyethyl) iminodiacetic acid (EDG), aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)-aspartic acid (SMAS), N-(2-sulfoethyl)-aspartic acid (SEAS), N-(2-sulfomethyl)-glutamic acid (SMGL), N-(2-sulfoethyl)-glutamic acid (SEGL), N-methyliminodiacetic acid (MIDA), α-alanine-N, N-diacetic acid (α-ALDA), serine-N, N-diacetic acid (SEDA), isoserine-N, N-diacetic acid (ISDA), phenylalanine-N, N-diacetic acid (PHDA), anthranilic acid-N, N-diacetic acid (ANDA), sulfanilic acid-N, N-diacetic acid (SLDA), taurine-N, N-diacetic acid (TUDA) and sulfomethyl-N, N-diacetic acid (SMDA), N-(2-hydroxyethyl)-ethylidenediamine-N, N', N'-triacetate (HEDTA), diethanolglycine (DEG), diethylenetriamine penta(methylenephosphonic acid) (DTPMP), aminotris(methylenephosphonic acid) (ATMP), and combinations and salts thereof. Further exemplary builders and/or co-builders are described in, e.g., WO 2009/102854, U.S. Pat. No. 5,977,053.

Bleaching Systems

The detergent may contain 0-50% by weight of a bleaching system. Any bleaching system known in the art for use in laundry detergents may be utilized. Suitable bleaching system components include bleaching catalysts, photobleaches, bleach activators, sources of hydrogen peroxide such as sodium percarbonate and sodium perborates, preformed peracids and mixtures thereof. Suitable preformed peracids include, but are not limited to, peroxycarboxylic acids and salts, percarbonic acids and salts, perimidic acids and salts, peroxymonosulfuric acids and salts, for example, Oxone®, and mixtures thereof. Non-limiting examples of bleaching systems include peroxide-based bleaching systems, which may comprise, for example, an inorganic salt, including alkali metal salts such as sodium salts of perborate (usually mono- or tetra-hydrate), percarbonate, persulfate, perphosphate, persilicate salts, in combination with a peracid-forming bleach activator. The term bleach activator is meant herein as a compound which reacts with peroxygen bleach like hydrogen peroxide to form a peracid. The peracid thus formed constitutes the activated bleach. Suitable bleach activators to be used herein include those belonging to the class of esters amides, imides or anhydrides. Suitable examples are tetracetylethylene diamine (TAED), sodium 4-[(3,5,5-trimethylhexanoyl)oxy]benzene sulfonate (ISONOBS), diperoxy dodecanoic acid, 4-(dodecanoyloxy)benzenesulfonate (LOBS), 4-(decanoyloxy)benzenesulfonate, 4-(decanoyloxy)benzoate (DOBS), 4-(nonanoyloxy)-benzenesulfonate (NOBS), and/or those disclosed in WO 98/17767. A particular family of bleach activators of interest was disclosed in EP624154 and particularly preferred in that family is acetyl triethyl citrate (ATC). ATC or a short chain triglyceride like triacetin has the advantage that it is environmental friendly as it eventually degrades into citric acid and alcohol. Furthermore acetyl triethyl citrate and triacetin has a good hydrolytical stability in the product upon storage and it is an efficient bleach activator. Finally ATC provides a good building capacity to the laundry additive. Alternatively, the bleaching system may comprise peroxyacids of, for example, the amide, imide, or sulfone type. The bleaching system may also comprise peracids such as 6-(phthalimido)peroxyhexanoic acid (PAP). The bleaching system may also include a bleach catalyst. In some embodiments the bleach component may be an organic catalyst selected from the group consisting of organic catalysts having the following formulae:

(i)

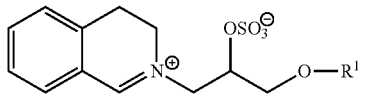

(ii)

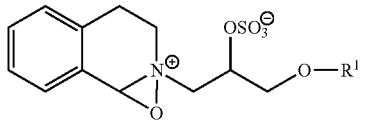

and mixtures thereof; wherein each $R^1$ is independently a branched alkyl group containing from 9 to 24 carbons or linear alkyl group containing from 11 to 24 carbons, preferably each $R^1$ is independently a branched alkyl group containing from 9 to 18 carbons or linear alkyl group containing from 11 to 18 carbons, more preferably each $R^1$ is independently selected from the group consisting of 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl. Other exemplary bleaching systems are described, e.g., in WO 2007/087258, WO 2007/087244, WO 2007/087259 and WO 2007/087242. Suitable photobleaches may for example be sulfonated zinc phthalocyanine.

Polymers

The detergent may contain 0-10% by weight, such as 0.5-5%, 2-5%, 0.5-2% or 0.2-1% of a polymer. Any polymer known in the art for use in detergents may be utilized. The polymer may function as a co-builder as mentioned above, or may provide antiredeposition, fiber protection, soil release, dye transfer inhibition, grease cleaning and/or anti-foaming properties. Some polymers may have more than one of the above-mentioned properties and/or more than one of the below-mentioned motifs. Exemplary polymers include (carboxymethyl)cellulose (CMC), poly(vinyl alcohol) (PVA), poly(vinylpyrrolidone) (PVP), poly(ethyleneglycol) or poly(ethylene oxide) (PEG), ethoxylated poly(ethyleneimine), carboxymethyl inulin (CMI), and polycarboxylates such as PAA, PAA/PMA, poly-aspartic acid, and lauryl methacrylate/acrylic acid copolymers, hydrophobically modified CMC (HM-CMC) and silicones, copolymers of terephthalic acid and oligomeric glycols, copolymers of poly(ethylene terephthalate) and poly(oxyethene terephthalate) (PET-POET), PVP, poly(vinylimidazole) (PVI), poly(vinylpyridine-N-oxide) (PVPO or PVPNO) and polyvinylpyrrolidone-vinylimidazole (PVPVI). Further exemplary polymers include sulfonated polycarboxylates, polyethylene oxide and polypropylene oxide (PEO-PPO) and diquaternium ethoxy sulfate. Other exemplary polymers are disclosed in, e.g., WO 2006/130575 and U.S. Pat. No. 5,955,415. Salts of the above-mentioned polymers are also contemplated.

Fabric Hueing Agents

The detergent compositions of the present invention may also include fabric hueing agents such as dyes or pigments, which when formulated in detergent compositions can deposit onto a fabric when said fabric is contacted with a wash liquor comprising said detergent compositions and thus altering the tint of said fabric through absorption/reflection of visible light. Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example as described in WO 2005/03274, WO 2005/03275, WO 2005/03276 and EP 1876226 (hereby incorporated by reference). The detergent composition preferably comprises from about 0.00003 wt % to about 0.2 wt %, from about 0.00008 wt % to about 0.05 wt %, or even from about 0.0001 wt % to about 0.04 wt % fabric hueing agent. The composition may comprise from 0.0001 wt % to 0.2 wt % fabric hueing agent, this may be especially preferred when the composition is in the form of a unit dose pouch. Suitable hueing agents are also disclosed in, e.g., WO 2007/087257 and WO 2007/087243.

Detergent Enzyme(s)

The detergent additive as well as the detergent composition may comprise one or more (additional) enzymes, such as those mentioned above under the heading "Enzyme".

In general the properties of the selected enzyme(s) should be compatible with the selected detergent, (i.e., pH-optimum, compatibility with other enzymatic and non-enzymatic ingredients, etc.), and the enzyme(s) should be present in effective amounts.

The detergent enzyme(s) may be included in a detergent composition by adding separate additives containing one or more enzymes, or by adding a combined additive comprising all of these enzymes. A detergent additive of the invention, i.e., a separate additive or a combined additive, can be formulated, for example, as a granulate, liquid, slurry, etc. Preferred detergent additive formulations are granulates, in particular non-dusting granulates, liquids, in particular stabilized liquids, or slurries.

The detergent enzyme(s) may be included in a detergent composition by adding separate additives containing one or more enzymes, or by adding a combined additive comprising all of these enzymes. A detergent additive of the invention, i.e., a separate additive or a combined additive is formulated as a granule of the invention.

Adjunct Materials

Any detergent components known in the art for use in laundry detergents may also be utilized. Other optional detergent components include anti-corrosion agents, anti-shrink agents, anti-soil redeposition agents, anti-wrinkling agents, bactericides, binders, corrosion inhibitors, disintegrants/disintegration agents, dyes, enzyme stabilizers (including boric acid, borates, CMC, and/or polyols such as propylene glycol), fabric conditioners including clays, fillers/processing aids, fluorescent whitening agents/optical brighteners, foam boosters, foam (suds) regulators, perfumes, soil-suspending agents, softeners, suds suppressors, tarnish inhibitors, and wicking agents, either alone or in combination. Any ingredient known in the art for use in laundry detergents may be utilized. The choice of such ingredients is well within the skill of the artisan.

Dispersants—

The detergent compositions of the present invention can also contain dispersants. In particular powdered detergents may comprise dispersants. Suitable water-soluble organic materials include the homo- or co-polymeric acids or their salts, in which the polycarboxylic acid comprises at least two carboxyl radicals separated from each other by not more than two carbon atoms. Suitable dispersants are for example described in Powdered Detergents, Surfactant science series volume 71, Marcel Dekker, Inc.

Dye Transfer Inhibiting Agents—

The detergent compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

Fluorescent Whitening Agent—

The detergent compositions of the present invention will preferably also contain additional components that may tint articles being cleaned, such as fluorescent whitening agent or optical brighteners. Fluorescent whitening agents, also referred to as optical brighteners, optical brightening agents, or fluorescent brightening agents, are dyes that absorb light in the ultraviolet and violet region (usually 340-370 nm) of the electromagnetic spectrum, and re-emit light in the blue region (typically 420-470 nm). These agents are often used to enhance the appearance of color of fabric and paper, causing a whitening effect, making materials look less yellow by increasing the overall amount of blue light reflected.

Fluorescent whitening agents are well known in the art, and many such fluorescent agents are available commercially. Usually, fluorescent agents are supplied and used in the form of their alkali metal salts, for example, the sodium salts.

Preferred fluorescent agents are selected from the classes, distyrylbiphenyls, triazinylaminostilbenes, bis(1,2,3-triazol-2-yl)stilbenes, bis(benzo[b]furan-2-yl)biphenyls, 1,3-diphenyl-2-pyrazolines, thiophenediyl benzoxazole, and courmarins. The fluorescent agent is preferably sulfonated.

Preferred classes of fluorescent agents are: di-styryl biphenyl compounds, e.g., Tinopal™ CBS-X; di-amine stilbene di-sulphonic acid compounds, e.g., Tinopal DMS-X and Blankophor™ HRH; pyrazoline compounds, e.g., Blankophor SN; and thiophenediyl benzoxazole compounds, e.g., Tinopal OB.

Fluorescent agents are also described in McElhone, H. J. (2009), "Fluorescent Whitening Agents", Kirk-Othmer Encyclopedia of Chemical Technology, 1-16, DOI: 10.1002/0471238961.0612211513030512.a01.pub2.

Suitable fluorescent brightener levels include lower levels of from about 0.01, from 0.05, from about 0.1 or even from about 0.2 wt % to upper levels of 0.5 or even 0.75 wt %; such as from 0.01 wt % to 0.5 wt %.

Soil Release Polymers—

The detergent compositions of the present invention may also include one or more soil release polymers which aid the removal of soils from fabrics such as cotton and polyester based fabrics, in particular the removal of hydrophobic soils from polyester based fabrics. The soil release polymers may for example be nonionic or anionic terephthalte based polymers, polyvinyl caprolactam and related copolymers, vinyl graft copolymers, polyester polyamides see for example Chapter 7 in Powdered Detergents, Surfactant science series volume 71, Marcel Dekker, Inc. Another type of soil release polymers are amphiphilic alkoxylated grease cleaning polymers comprising a core structure and a plurality of alkoxylate groups attached to that core structure. The core structure may comprise a polyalkylenimine structure or a polyalkanolamine structure as described in detail in WO 2009/087523 (hereby incorporated by reference). Furthermore random graft co-polymers are suitable soil release polymers. Suitable graft co-polymers are described in more detail in WO 2007/138054, WO 2006/108856 and WO 2006/113314 (hereby incorporated by reference). Other soil release polymers are substituted polysaccharide structures especially substituted cellulosic structures such as modified cellulose deriviatives such as those described in EP 1867808 or WO 2003/040279 (both are hereby incorporated by reference). Suitable cellulosic polymers include cellulose, cellulose ethers, cellulose esters, cellulose amides and mixtures thereof. Suitable cellulosic polymers include anionically modified cellulose, nonionically modified cellulose, cationically modified cellulose, zwitterionically modified cellulose, and mixtures thereof. Suitable cellulosic polymers include methyl cellulose, carboxy methyl cellulose, ethyl cellulose, hydroxyl ethyl cellulose, hydroxyl propyl methyl cellulose, ester carboxy methyl cellulose, and mixtures thereof.

Anti-Redeposition Agents—

The detergent compositions of the present invention may also include one or more anti-redeposition agents such as carboxymethylcellulose (CMC), polyvinyl alcohol (PVA), polyvinylpyrrolidone (PVP), polyoxyethylene and/or polyethyleneglycol (PEG), homopolymers of acrylic acid, copolymers of acrylic acid and maleic acid, and ethoxylated polyethyleneimines. The cellulose based polymers described under soil release polymers above may also function as anti-redeposition agents.

Other suitable adjunct materials include, but are not limited to, anti-shrink agents, anti-wrinkling agents, bactericides, binders, carriers, dyes, enzyme stabilizers, fabric softeners, fillers, foam regulators, perfumes, pigments, sod suppressors, solvents, and structurants for liquid detergents and/or structure elasticizing agents.

Laundry Soap Bars

The granule of the invention may be added to laundry soap bars and used for hand washing laundry, fabrics and/or textiles. The term laundry soap bar includes laundry bars, soap bars, combo bars, syndet bars and detergent bars. The types of bar usually differ in the type of surfactant they contain, and the term laundry soap bar includes those containing soaps from fatty acids and/or synthetic soaps. The laundry soap bar has a physical form which is solid and not a liquid, gel or a powder at room temperature. The term solid is defined as a physical form which does not significantly change over time, i.e., if a solid object (e.g., laundry soap bar) is placed inside a container, the solid object does not change to fill the container it is placed in. The bar is a solid typically in bar form but can be in other solid shapes such as round or oval.

The laundry soap bar may contain one or more additional enzymes, protease inhibitors such as peptide aldehydes (or hydrosulfite adduct or hemiacetal adduct), boric acid, borate, borax and/or phenylboronic acid derivatives such as 4-formylphenylboronic acid, one or more soaps or synthetic surfactants, polyols such as glycerine, pH controlling compounds such as fatty acids, citric acid, acetic acid and/or formic acid, and/or a salt of a monovalent cation and an organic anion wherein the monovalent cation may be for example $Na^+$, $K^+$ or $NH_4^+$ and the organic anion may be for example formate, acetate, citrate or lactate such that the salt of a monovalent cation and an organic anion may be, for example, sodium formate.

The laundry soap bar may also contain complexing agents like EDTA and HEDP, perfumes and/or different type of fillers, surfactants, e.g., anionic synthetic surfactants, builders, polymeric soil release agents, detergent chelators, stabilizing agents, fillers, dyes, colorants, dye transfer inhibitors, alkoxylated polycarbonates, suds suppressers, structurants, binders, leaching agents, bleaching activators, clay soil removal agents, anti-redeposition agents, polymeric dispersing agents, brighteners, fabric softeners, perfumes and/or other compounds known in the art.

The laundry soap bar may be processed in conventional laundry soap bar making equipment such as but not limited to: mixers, plodders, e.g., a two stage vacuum plodder, extruders, cutters, logo-stampers, cooling tunnels and wrappers. The invention is not limited to preparing the laundry soap bars by any single method. The premix of the invention may be added to the soap at different stages of the process. For example, the premix containing a soap, a granule of the invention, optionally one or more additional enzymes, a protease inhibitor, and a salt of a monovalent cation and an organic anion may be prepared and and the mixture is then plodded. The enzyme and optional additional enzymes may be added at the same time as the protease inhibitor for example in liquid form. Besides the mixing step and the plodding step, the process may further comprise the steps of milling, extruding, cutting, stamping, cooling and/or wrapping.

Compositions, Methods and Uses

The invention is further described in the following embodiments:

Embodiment 1

A granule comprising (a) at least three cores comprising a biological active and a plasticizable polymer, wherein the cores are made of a material having an elongation upon break of at least 30%, and wherein the diameter of the cores is at least 50 μm and at most two thirds of the diameter of the granule;

(b) a solid matrix interspacing the cores of (a), wherein the solid matrix is made of a material having an elongation upon break of less than 30%; and (c) optionally a coating consisting of one or more layer(s) surrounding the granule.

Embodiment 2

The granule of Embodiment 1, wherein the cores are made of a material having an elongation upon break of at least 50%.

Embodiment 3

The granule of Embodiment 1 or 2, wherein the cores are made of a material having an elongation upon break of at least 100%.

Embodiment 4

The granule of any one of Embodiments 1-3, wherein the solid matrix is made of a material having an elongation upon break of less than 20%.

Embodiment 5

The granule of any one of Embodiments 1-4, wherein the solid matrix is made of a material having an elongation upon break of less than 10%.

Embodiment 6

The granule of any one of Embodiments 1-5, wherein the solid matrix is made of a material having an elongation upon break of less than 5%.

Embodiment 7

The granule of any one of Embodiments 1-6, wherein the solid matrix is made of a material having an elongation upon break of less than 1%.

Embodiment 8

The granule of any one of Embodiments 1-7, wherein elongation upon break is measured according to ASTM D882; specifically, ASTM D882-10.

Embodiment 9

The granule of any one of Embodiments 1-8, wherein the solid matrix comprises at least 50% w/w of a crystalline material.

Embodiment 10

The granule of any one of Embodiments 1-9, wherein the solid matrix comprises at least 70% w/w of a crystalline material.

Embodiment 11

The granule of any one of Embodiments 1-10, wherein the solid matrix comprises at least 90% w/w of a crystalline material.

Embodiment 12

The granule of any one of Embodiments 1-11, wherein the solid matrix comprises at least 95% w/w of a crystalline material.

Embodiment 13

The granule of any one of Embodiments 1-12, wherein the solid matrix essentially consists of a crystalline material.

Embodiment 14

The granule of any one of Embodiments 9-13, wherein the crystalline material is one or more silicas, clays, and/or inorganic salts.

Embodiment 15

The granule of Embodiment 14, wherein the inorganic salts are salts of sulfate, carbonate, nitrate, or chloride.

Embodiment 16

The granule of Embodiment 14 or 15, wherein the inorganic salts are selected from the group consisting of $Na_2SO_4$, $K_2SO_4$, $CaSO_4$, $MgSO_4$, $ZnSO_4$, $(NH_4)_2SO_4$, $Na_2CO_3$, $NaHCO_3$, $K_2CO_3$, $KHCO_3$, $CaCO_3$, $MgCO_3$, $ZnCO_3$, $(NH_4)_2CO_3$, $NaNO_3$, $KNO_3$, $Ca(NO_3)_2$, $Mg(NO_3)_2$, $Zn(NO_3)_2$, $NH_4NO_3$, NaCl, KCl, $CaCl_2$), $MgCl_2$, $ZnCl_2$, and $NH_4Cl$.

Embodiment 17

The granule of any one of Embodiments 1-16, wherein the diameter of the cores is at least 50 μm and at most half of the diameter of the granule.

Embodiment 18

The granule of any one of Embodiments 1-17, wherein the plasticizable polymer is selected from the group consisting of polyvinyl alcohols (PVA), polyethylene glycols (PEG), polyethylene oxides (PEO), polyvinyl pyrrolidones (PVP), cellulose ethers, alginates, gelatin, modified starches and substituted derivatives, hydrolysates and copolymers thereof.

Embodiment 19

The granule of any one of Embodiments 1-18, wherein the plasticizable polymer is selected from polyvinyl alcohols (PVA) and polyethylene glycols (PEG).

Embodiment 20

The granule of any one of Embodiments 1-19, wherein the cores comprise at least 50% of the plasticizable polymer.

Embodiment 21

The granule of any one of Embodiments 1-20, wherein the cores comprise at least 70% of the plasticizable polymer.

Embodiment 22

The granule of any one of Embodiments 1-21, wherein the cores comprise at least 90% of the plasticizable polymer.

Embodiment 23

The granule of any one of Embodiments 1-22, wherein the cores comprise a polyol.

Embodiment 24

The granule of Embodiment 23, wherein the polyol is glycerol, ethylene glycol, diethylene glycol, triethylene glycol, propylene glycol, dipropylene glycol, or polyethylene glycol (PEG) having an average molecular weight below about 800, or mixtures thereof.

Embodiment 25

The granule of any one of Embodiments 1-24, wherein the biological active is an enzyme or a microorganism.

Embodiment 26

The granule of any one of Embodiments 1-25, wherein the biological active is an enzyme selected from the group consisting of protease, lipase, cutinase, amylase, carbohydrase, cellulase, pectinase, mannanase, arabinase, galactanase, xylanase, DNase, perhydrolase, oxidase, laccase, peroxygenase, haloperoxidase, and peroxidase.

Embodiment 27

The granule of any one of Embodiments 1-25, wherein the biological active is a bacterial spore, such as a *Bacillus* endospore.

Embodiment 28

An enzyme granule comprising (a) at least three cores comprising an enzyme and at least 50% w/w of a plasticizable polymer, wherein the diameter of the cores is at least 50 μm and at most two thirds of the diameter of the granule;

(b) a solid matrix interspacing the cores of (a), wherein the solid matrix comprises at least 50% w/w of a crystalline material; and (c) optionally a coating consisting of one or more layer(s) surrounding the granule.

Embodiment 29

The granule of Embodiment 28, wherein the solid matrix comprises at least 70% w/w of a crystalline material.

Embodiment 30

The granule of Embodiment 28 or 29, wherein the solid matrix comprises at least 90% w/w of a crystalline material.

Embodiment 31

The granule of any one of Embodiments 28-30, wherein the solid matrix comprises at least 95% w/w of a crystalline material.

Embodiment 32

The granule of any one of Embodiments 28-31, wherein the solid matrix essentially consists of a crystalline material.

Embodiment 33

The granule of any one of Embodiments 29-32, wherein the crystalline material is one or more silicas, clays, and/or inorganic salts.

Embodiment 34

The granule of Embodiment 33, wherein the inorganic salts are salts of sulfate, carbonate, nitrate, or chloride.

Embodiment 35

The granule of Embodiment 33 or 34, wherein the inorganic salts are selected from the group consisting of $Na_2SO_4$, $K_2SO_4$, $CaSO_4$, $MgSO_4$, $ZnSO_4$, $(NH_4)_2SO_4$, $Na_2CO_3$, $NaHCO_3$, $K_2CO_3$, $KHCO_3$, $CaCO_3$, $MgCO_3$, $ZnCO_3$, $(NH_4)_2CO_3$, $NaNO_3$, $KNO_3$, $Ca(NO_3)_2$, $Mg(NO_3)_2$, $Zn(NO_3)_2$, $NH_4NO_3$, NaCl, KCl, $CaCl_2$), $MgCl_2$, $ZnCl_2$, and $NH_4Cl$.

Embodiment 36

The granule of any one of Embodiments 28-35, wherein the diameter of the cores is at least 50 μm and at most half of the diameter of the granule.

Embodiment 37

The granule of any one of Embodiments 28-36, wherein the plasticizable polymer is selected from the group consisting of polyvinyl alcohols (PVA), polyethylene glycols (PEG), polyethylene oxides (PEO), polyvinyl pyrrolidones (PVP), cellulose ethers, alginates, gelatin, modified starches and substituted derivatives, hydrolysates and copolymers thereof.

Embodiment 38

The granule of any one of Embodiments 28-37, wherein the plasticizable polymer is selected from polyvinyl alcohols (PVA) and polyethylene glycols (PEG).

Embodiment 39

The granule of any one of Embodiments 28-38, wherein the cores comprise at least 70% of the plasticizable polymer.

Embodiment 40

The granule of any one of Embodiments 28-39, wherein the cores comprise at least 90% of the plasticizable polymer.

Embodiment 41

The granule of any one of Embodiments 28-40, wherein the cores comprise a polyol.

Embodiment 42

The granule of Embodiment 41, wherein the polyol is glycerol, ethylene glycol, diethylene glycol, triethylene glycol, propylene glycol, dipropylene glycol, or polyethylene glycol (PEG) having an average molecular weight below about 800, or mixtures thereof.

Embodiment 43

The granule of any one of Embodiments 28-42, wherein the enzyme is selected from the group consisting of protease, lipase, cutinase, amylase, carbohydrase, cellulase, pectinase, mannanase, arabinase, galactanase, xylanase, DNase, perhydrolase, oxidase, laccase, peroxygenase, haloperoxidase, and peroxidase.

Embodiment 44

An enzyme granule comprising (a) at least three cores comprising an enzyme and at least 50% w/w of a plasticizable polymer, wherein the diameter of the cores is at least 50 μm and at most two thirds of the diameter of the granule;

(b) a solid matrix interspacing the cores of (a), wherein the solid matrix comprises at least 50% w/w of silicas, clays, and/or inorganic salts of sulfate, carbonate, nitrate, or chloride; and (c) optionally a coating consisting of one or more layer(s) surrounding the granule.

Embodiment 45

The granule of Embodiment 44, wherein the solid matrix comprises at least 70% w/w of silicas, clays, and/or inorganic salts.

Embodiment 46

The granule of Embodiment 44 or 45, wherein the solid matrix comprises at least 90% w/w of silicas, clays, and/or inorganic salts.

Embodiment 47

The granule of any one of Embodiments 44-46, wherein the solid matrix comprises at least 95% w/w of silicas, clays, and/or inorganic salts.

Embodiment 48

The granule of any one of Embodiments 44-47, wherein the solid matrix essentially consists of silicas, clays, and/or inorganic salts.

Embodiment 49

The granule of any one of Embodiments 44-48, wherein the inorganic salts are selected from the group consisting of $Na_2SO_4$, $K_2SO_4$, $CaSO_4$, $MgSO_4$, $ZnSO_4$, $(NH_4)_2SO_4$, $Na_2CO_3$, $NaHCO_3$, $K_2CO_3$, $KHCO_3$, $CaCO_3$, $MgCO_3$, $ZnCO_3$, $(NH_4)_2CO_3$, $NaNO_3$, $KNO_3$, $Ca(NO_3)_2$, $Mg(NO_3)_2$, $Zn(NO_3)_2$, $NH_4NO_3$, NaCl, KCl, $CaCl_2$), $MgCl_2$, $ZnCl_2$, and $NH_4Cl$.

Embodiment 50

The granule of any one of Embodiments 44-49, wherein the diameter of the cores is at least 50 μm and at most half of the diameter of the granule.

Embodiment 51

The granule of any one of Embodiments 44-50, wherein the plasticizable polymer is selected from the group consisting of polyvinyl alcohols (PVA), polyethylene glycols (PEG), polyethylene oxides (PEO), polyvinyl pyrrolidones (PVP), cellulose ethers, alginates, gelatin, modified starches and substituted derivatives, hydrolysates and copolymers thereof.

Embodiment 52

The granule of any one of Embodiments 44-51, wherein the plasticizable polymer is selected from polyvinyl alcohols (PVA) and polyethylene glycols (PEG).

Embodiment 53

The granule of any one of Embodiments 44-52, wherein the cores comprise at least 70% of the plasticizable polymer.

Embodiment 54

The granule of any one of Embodiments 44-53, wherein the cores comprise at least 90% of the plasticizable polymer.

Embodiment 55

The granule of any one of Embodiments 44-54, wherein the cores comprise a polyol.

Embodiment 56

The granule of Embodiment 55, wherein the polyol is glycerol, ethylene glycol, diethylene glycol, triethylene glycol, propylene glycol, dipropylene glycol, or polyethylene glycol (PEG) having an average molecular weight below about 800, or mixtures thereof.

Embodiment 57

The granule of any one of Embodiments 44-56, wherein the enzyme is selected from the group consisting of protease, lipase, cutinase, amylase, carbohydrase, cellulase, pectinase, mannanase, arabinase, galactanase, xylanase, DNase, perhydrolase, oxidase, laccase, peroxygenase, haloperoxidase, and peroxidase.

Embodiment 58

The granule of any one of the preceding Embodiments, wherein the cores are prepared using spray drying.

Embodiment 59

The granule of any one of the preceding Embodiments, which includes a salt coating and/or a polyethylene glycol (PEG) coating surrounding the granule.

Embodiment 60

The granule of any one of the preceding Embodiments, which includes a coating comprising at least 60% w/w of a salt having a constant humidity at 20° C. of at least 60%.

Embodiment 61

The granule of any one of the preceding Embodiments, wherein the coating makes up 5-70% by weight relative to the cores and the solid matrix.

Embodiment 62

A detergent composition comprising a detergent builder, a surfactant, and a granule according to any one of the preceding Embodiments.

Embodiment 63

The detergent composition of Embodiment 62, which is a particulate composition.

Embodiment 64

Use of a granule according to any one of the preceding Embodiments as a component in a process for manufacturing a detergent composition.

The present invention is further described by the following examples which should not be construed as limiting the scope of the invention.

EXAMPLES

Chemicals were commercial products of at least reagent grade. The enzyme used in the Examples was a protease (Savinase™) from Novozymes A/S.

Shear Stress Method

In order to evaluate whether the release of active dust increases after subjecting the particle to shear stress, a "shear stress method" is applied. The "shear stress method" uses a grinding device as a pre-analysis step before measuring active dust release, thereby providing a more drastic and realistic description (in terms of abnormal processing in the application) of particle robustness against shear stress. The release of active dust is analyzed by the well-known Heubach method (as described by the Active Dust Analysis) before and after applying a shear stress to a raw granulate (uncoated granulate) by means of a grinding device. In this way the particle robustness is evaluated in the core itself, independently of the protective coating applied.

The grinding device is a MillMaster Grain Mill manufactured by Mashmaster Pty Ltd (Francis Hemeter, PO Box 1768, Coorparoo D.C., Qld 4151, Australia)—some specifications of this instrument are:

130 mm precision machined rollers;

38 mm diameter Stainless Steel rollers; and 0.1 mm to 1.9 mm infinitely adjustable gap setting for precision control and accuracy.

The grinding device (MillMaster Grain Mill) has two dials which are eccentric adjustors for the desired gap. These eccentric adjustors have been modified in order to achieve gaps as low as 0 mm (from the originally available 0.1 mm to 1.9 mm). The gap is adjusted before performing a grinding assay by measuring it and ensuring that it is equal or smaller than half the D10, i.e., the 10% percentile of the particle size distribution (meaning that 10% of the volume of the particles has a size equal or less than the given value). For example, if the granules are sieved between 300-1200 microns, and the D10 is evaluated to be 400 microns, the gap must be adjusted below 200 microns. In the reported examples, the gap was adjusted to 150 microns in order to ensure the mentioned requirement with a safety margin, as the product to be analyzed was sieved between 300-1200 microns. In this way, the vast majority of particles will be shrinked while passing through the grinder, thereby suffering a high shear stress resulting in particle compression and/or breakage.

The grinder device is used at a roller rotation speed of 30-40 rpm and the sample is fed at a rate of 4 to 6 g/min.

The invention may reduce the amount of dust of the biological active, compared to the total amount of the biological active (for example, the amount of enzyme dust compared to the total amount of enzyme), to less than 1:10000 (=0.0001). This is considered a sufficient reduction of dust for use in a detergent manufacturing process.

Sample Preparation

The shear stress method and the analysis of active dust is applied to a mixture of 10% w/w active-containing granules, and 90% placebo T-granules (meaning enzyme-free granules manufactured according to U.S. Pat. No. 4,106,991 with the exception that sodium sulfate was used instead of sodium chloride), in order to simulate active-containing particles, possibly with plastic behavior, interacting with other particles of a different nature, as this will be the case in the application of the product.

The mixture is fed to the grinding device in sample size of 60 g. 50 g of the resulting grinded product are analyzed for active dust according to the Active Dust Analysis, resulting in the number "Active dust after grinding". Likewise, 50 g of undisturbed mixture (not-grinded active-containing particles) are analyzed by the Active Dust Analysis, resulting in the number "Active dust before grinding".

Active Dust Analysis

The active dust release is analyzed by the well-known Heubach Type I dust meter by analyzing the activity of the biological active on the dust filter and converting the result into nanograms of biological active divided by grams of sample. In this way the result is independent of possible non-active dust generated by the placebo T-granule in the mixture.

The weighed out sample amount is placed in a rotating drum containing three integrated blades. A horizontal stream passes through the drum with airflow at 20 L/min. The airflow leads the finest particles further through a non-rotating, horizontal glass column in which the largest particles are separated. The airborne dust is lead further and collected on a filter in the filter house. The amount of biological active dust on the filter is determined by means of an analytical method for dust filters for the biological active in question.

Conditions of Analysis:
Temperature: Room temperature
Sample amount: 50.0 g
Air flow: 20 L/min.
Speed of rotation: 30 rpm
Time of analysis: 5 min.
Humidity of air: 30-70% RH
Fiber glass filter: 5 cm GF92

Example 1

80 kg of a Protease containing solution (8% by weight active enzyme and 78% by weight water) was spray dried by adjusting the feed rate to achieve an outlet temperature of 70° C. using 580 kg/h air at 160° C. The rotation of the atomization wheel was set to 225 rpm by using 11 kg/h atomization air.

A T-granule was prepared according to U.S. Pat. No. 4,106,991 (sodium sulfate was used instead of sodium chloride), containing approximately 10% of the spray dried enzyme containing cores (protease content as shown in Table 1) in the matrix of the granule (raw granulate) on dry basis (not accounting for possible water in the granule). Active dust release before and after applying the "shear stress method" are shown in Table 2. It is clear from the results that when small and brittle spray dried powder is used it results in high release of active enzyme dust.

Example 2

46.3 kg of a mixture containing 28.8 kg enzyme solution (8% w/w active enzyme and 78% w/w water), 7.8 kg glycerol and 9.7 kg Maltodextrin (Glucidex 12) was prepared together with a 40% w/w maize starch suspension. Both feeds were simultaneously sprayed into a spray dryer with a ratio of 1 (i.e., 22 kg/h enzyme solution to 22 kg/h starch suspension) by adjusting the feed rate to achieve an outlet temperature of 70° C. using 580 kg/h air at 160° C. The nozzle pressure was set to 1.25 bar by using 56 kg/h air for atomization. The internal fluid bed was operated with approximately 200 kg/h air with an inlet temperature of 80° C.

A T-granule was prepared according to U.S. Pat. No. 4,106,991 (sodium sulfate was used instead of sodium chloride), containing approximately 16% of the spray dried enzyme containing cores (protease content as shown in Table 1) in the matrix of the granule (raw granulate) on dry basis (not accounting for possible water in the granule) resulting in a multitude of granules, as shown in Table 3. Active dust release before and after applying the "shear stress method" are shown in Table 2. The amount of active dust is significantly reduced compared to total dust due to the use of the big enzyme cores; however the cores seem to disintegrate during granulation what results lower reduction of active dust compared to Example 3-5.

Example 3

48 kg of a 17% w/w solution of polyvinyl alcohol (weight average MW being from 13,000 to 50,000 and a degree of hydrolysation of 90%) was mixed with 32 kg enzyme solution (8% w/w active enzyme and 78% w/w water) and 2.9 kg of a glycerol/MPG solution (60% w/w glycerol). Additionally a 40% w/w sodium chloride solution was prepared. Both solutions were simultaneously sprayed into a spray dryer with a ratio of 2.5 (i.e., 18 kg/h PVA solution to 7 kg/h salt solution) by adjusting the feed rate to achieve an outlet temperature of 75° C. using 590 kg/h air at 160° C. The nozzle pressure was set to 1.3 bar by using 62 kg/h air for atomization. The internal fluid bed was operated with 380 kg/h air with an inlet temperature of 70° C.

A T-granule was prepared according to U.S. Pat. No. 4,106,991 (sodium sulfate was used instead of sodium chloride), containing approximately 25% of the spray dried enzyme containing cores (protease content as shown in Table 1) in the matrix of the granule (raw granulate) on dry basis (not accounting for possible water in the granule) resulting in a multitude of granules, as shown in Table 3. Active dust release before and after applying the "shear stress method" are shown in Table 2. It is clear from the results that the inclusion of big elastic spray dried powder results in low release of active enzyme dust.

Example 4

41 kg of a 15% w/w solution of polyvinyl alcohol (weight average MW being from 85,000 to 124,000 and a degree of hydrolysation of 90%) was mixed with 32 kg enzyme solution (8% w/w active enzyme and 78% w/w water) and 2.1 kg of a glycerol/MPG solution (60% w/w glycerol). Additionally a 40% w/w maize starch suspension was prepared. Both feeds were simultaneously sprayed into a spray dryer with a ratio of 0.6 (i.e., 14 kg/h PVA solution to 23 kg/h starch suspension) by adjusting the feed rate to achieve an outlet temperature of 75° C. using 520 kg/h air at 175° C. The nozzle pressure was set to 1.3 bar by using 62 kg/h air for atomization. The internal fluid bed was operated with 270 kg/h air with an inlet temperature of 80° C.

A T-granule was prepared according to U.S. Pat. No. 4,106,991 (sodium sulfate was used instead of sodium chloride), containing approximately 42% of the spray dried enzyme containing cores (protease content as shown in Table 1) in the matrix of the granule (raw granulate) on dry basis (not accounting for possible water in the granule) resulting in a multitude of granules, as shown in Table 3. Active dust release before and after applying the "shear stress method" are shown in Table 2. It is clear from the results that the inclusion of big elastic spray dried powder results in low release of active enzyme dust.

Example 5

24 kg of a 17% w/w solution of polyvinyl alcohol (weight average MW being from 85,000 to 124,000 and a degree of hydrolysation of 90%) was mixed with 32 kg enzyme solution (8% w/w active enzyme and 78% w/w water) and 8 kg glycerol. Additionally a 35% w/w maize starch suspension was prepared. Both feeds were simultaneously sprayed into a spray dryer with a ratio of 0.6 (i.e., 14 kg/h PVA solution to 23 kg/h starch suspension) by adjusting the feed rate to achieve an outlet temperature of 75° C. using 535 kg/h air at 170° C. The nozzle pressure was set to 1.25 bar by using 56 kg/h air for atomization. The internal fluid bed was operated with approximately 200 kg/h air with an inlet temperature of 80° C. After spray drying the powder (cores) was de-dusted in the spray dryer by using the internal fluid bed.

A T-granule was prepared according to U.S. Pat. No. 4,106,991 (sodium sulfate was used instead of sodium chloride), containing approximately 42% of the spray dried enzyme containing cores (protease content as shown in Table 1) in the matrix of the granule (raw granulate) on dry basis (not accounting for possible water in the granule) resulting in a multitude of granules, as shown in Table 3. Active dust release before and after applying the "shear stress method" are shown in Table 2. It is clear from the results that the inclusion of big elastic cores results in low release of active enzyme dust.

TABLE 1

Properties of spray dried cores

| Example | Core material/ plasticizable polymer | Plasticizer | Elongation upon break* [%] | D50 [μm] |
|---|---|---|---|---|
| 1 | Concentrate | none | — | 50 |
| 2 | Maltodextrin | Glycerol | — | 200 |
| 3 | PVA | Glycerol/MPG | >100 | 173 |
| 4 | PVA | Glycerol/MPG | >100 | 284 |
| 5 | PVA | Glycerol | >100 | 318 |

*measured according to ASTM D882-10.

TABLE 2

Release of active enzyme dust before and after applying the shear stress method to the raw granulate.

| Example | Protease content [mg/g] | Active dust before grinding [ng/g] | Active dust after grinding [ng/g] | Total dust after grinding [ppm] | Enzyme dust to total dust after grinding | Enzyme dust fraction of total enzyme after grinding |
|---|---|---|---|---|---|---|
| 1 | 70.6 | 46 | 6210 | 245 | 1:4 | 1:1136 |
| 2 | 41.9 | 29 | 788 | 1012 | 1:128 | 1:5317 |
| 3 | 51.0 | 20 | 84 | 620 | 1:738 | 1:60714 |
| 4 | 60.6 | 11 | 101 | 268 | 1:265 | 1:60000 |
| 5 | 74.4 | 8 | 18 | 180 | 1:1000 | 1:413333 |

TABLE 3

Properties of the cores and granules

| | Cores | | Granules | | Ratios | |
|---|---|---|---|---|---|---|
| Example | D(50) [μm] | D(50) based volume [μL] | D(50) [μm] | D(50) based volume [μL] | D(50)/D(50) [μm/μm] | D(50)/D(50) [μL/μL] |
| 1 | 50 | 0.0001 | 681 | 0.165 | 0.07 | 0.001 |
| 2 | 200 | 0.0056 | 753 | 0.224 | 0.27 | 0.025 |
| 3 | 173 | 0.0027 | 662 | 0.152 | 0.26 | 0.018 |
| 4 | 284 | 0.0120 | 432 | 0.078 | 0.66 | 0.154 |
| 5 | 318 | 0.0168 | 581 | 0.1027 | 0.55 | 0.164 |

The invention claimed is:

1. A granule comprising (a) at least three discrete cores each comprising a biological active and a plasticizable polymer within the core, wherein the cores are made of a material having an elongation upon break of at least 30%, and wherein the diameter of the cores is at least 50 μm and at most two thirds of the diameter of the granule;

(b) a solid matrix interspacing the cores of (a), wherein the solid matrix is made of a material having an elongation upon break of less than 30%; and (c) optionally a coating consisting of one or more layer(s) surrounding the granule.

2. The granule of claim 1, wherein the solid matrix comprises at least 50% w/w of a crystalline material.

3. The granule of claim 2, wherein the crystalline material is one or more silicas, clays, and/or inorganic salts.

4. The granule of claim 3, wherein the inorganic salts are salts of sulfate, carbonate, nitrate, or chloride.

5. The granule of claim 1, wherein the diameter of the cores is at least 50 μm and at most half of the diameter of the granule.

6. The granule of claim 1, wherein the plasticizable polymer is selected from the group consisting of polyvinyl alcohols (PVA), polyethylene glycols (PEG), polyethylene oxides (PEO), polyvinyl pyrrolidones (PVP), cellulose ethers, alginates, gelatin, modified starches and substituted derivatives, hydrolysates and copolymers thereof.

7. The granule of claim 6, wherein the cores comprise at least 50% of the plasticizable polymer.

8. The granule of claim 1, wherein the cores comprise a polyol.

9. The granule of claim 8, wherein the polyol is glycerol, ethylene glycol, diethylene glycol, triethylene glycol, propylene glycol, dipropylene glycol, or polyethylene glycol (PEG) having an average molecular weight below about 800, or mixtures thereof.

10. The granule of claim 1, wherein the biological active is an enzyme or a microorganism.

11. The granule of claim 1, wherein the biological active is an enzyme selected from the group consisting of protease, lipase, cutinase, amylase, carbohydrase, cellulase, pectinase, mannanase, arabinase, galactanase, xylanase, DNase, perhydrolase, oxidase, laccase, peroxygenase, haloperoxidase, and peroxidase.

12. The granule of claim 1, wherein the biological active is a bacterial spore.

13. A detergent composition comprising a detergent builder, a surfactant, and a granule according to claim 1.

14. The detergent composition of claim 13, which is a particulate composition.

15. The granule of claim 12, wherein the bacterial spore is a *Bacillus* endospore.

* * * * *